US006427861B1

(12) United States Patent
Cho

(10) Patent No.: US 6,427,861 B1
(45) Date of Patent: Aug. 6, 2002

(54) TOP LID FOR BEVERAGE CANS WITH OPENER INTEGRATED SANITARY COVER

(75) Inventor: Sung-Ho Cho, Kyongki-do (KR)

(73) Assignee: Bongjeong Cantech Co., Ltd. (KR)

( * ) Notice: Subject to any disclaimer, the term of this patent is extended or adjusted under 35 U.S.C. 154(b) by 0 days.

(21) Appl. No.: 09/697,916

(22) Filed: Oct. 27, 2000

Related U.S. Application Data

(63) Continuation-in-part of application No. PCT/KR99/00201, filed on Apr. 28, 1999.

(30) Foreign Application Priority Data

Apr. 29, 1998 (KR) ..... 98-15387
Apr. 9, 1999 (KR) ..... 99-12571

(51) Int. Cl.[7] ..... B65D 17/34
(52) U.S. Cl. ..... 220/269; 220/270; 220/906; 220/258.2
(58) Field of Search ..... 220/258, 269, 220/270, 906, 820, 821, 823, 258.2–258.5

(56) References Cited

U.S. PATENT DOCUMENTS 4,367,996 A * 1/1983 Sanuders ..... 220/270
4,433,792 A * 2/1984 Mandel ..... 220/269
4,480,763 A 11/1984 Schneider
4,880,137 A 11/1989 Wells
5,335,808 A 8/1994 Lee
5,813,559 A * 9/1998 Cho ..... 220/258
6,059,137 A * 5/2000 Westwood et al. ..... 220/258
6,098,830 A * 8/2000 Jamieson ..... 220/258

FOREIGN PATENT DOCUMENTS

GB 2085394 4/1982

* cited by examiner

*Primary Examiner*—Nathan J. Newhouse
(74) *Attorney, Agent, or Firm*—Cooper & Dunham LLP

(57) ABSTRACT

A top lid for beverage cans with an opener integrated sanitary cover is disclosed. The sanitary cover 8 is designed to cover the area around the opening piece 3*a* defined on the top lid 50 by a depressed seam 3*c*, thus protecting the lip contact portion of the top lid 50 from atmospheric impurities and keeping the can sanitary during storage of the can. The sanitary cover 8 also has a reinforced opener part 13 which presses down the opening piece 3*a* and breaks the piece 3*a* along the depressed seam 3*c* when the cover 8 is levered up. The opener part 13 has a reinforcing rib 13*b* improving the stiffness of the opener part 13, and so the opener part 13 reliably breaks the opening piece 3*a* without failure even though a high pressure acts on the interior surface of the opening piece 3*a*. The configuration and arrangement of the reinforcing means for the opener part 13 may be freely changed in accordance with the designed conditions of the can, or the interior pressure acting on the opening piece 3*a* and the size of the can. The sanitary cover 8 also has a thumb-operable resilient dome 6 used for elastically raising up the cover 8 when the dome 6 is pressed down by a thumb. Due to the dome 6, it is easy for a user to handle the cover 8 while levering up the cover 8 to open the top lid 50.

23 Claims, 34 Drawing Sheets

TOP LID FOR BEVERAGE CANS WITH OPENER INTEGRATED SANITARY COVER

This application is a Continuation-In-Part of International Application Ser. No. PCT/KR99/00201 with an international filing date of Apr. 28, 1999.

TECHNICAL FIELD

The present invention relates, in general, to beverage cans made of metal, such as aluminum or steel, and, more particularly, to a top lid for such beverage cans with an opener integrated sanitary cover, the sanitary cover being attached to the top lid using a locking member and being designed to sanitarily cover the lip contact portion of the top lid using its cover part during storage of the can and to reliably open the top lid without failure using its reinforced opener part.

BACKGROUND ART

In order to open and empty a beverage can made of metal, a lever opener, exteriorly attached to the top lid of the can using a locking member, such as a rivet, is levered up, thus breaking an opening piece of the lid along a depressed seam and forming a rounded opening on said lid. Such beverage cans are stored with the top lids being exposed to the atmosphere, and so the lip contact portion defined around the opening piece is regrettably contaminated by dust and other atmospheric impurities. During use of such a can, the lip contact portion, contaminated with such impurities, is bad for one's health. In an effort to overcome the above problem, a can, with a sanitary suction straw being provided at the can, was proposed. However, the can, with such a suction straw, is problematic in that it is very difficult to produce the can in great quantity, and so the can fails to be produced on a commercial scale.

In order to solve the problems experienced in the typical beverage cans, the inventor of this invention proposed a beverage can with a sanitary cover as disclosed in U.S. Pat. No. 5,813,559, corresponding to Korean Patent Registration No. 141,618. This can may be designed to have three types. That is, the can may have both a sanitary cover means and a lever opener, which are commonly and rotatably attached to the top lid of a can using one rivet, thus sanitarily covering the lip contact portion of the lid and being used for opening the lid, respectively. Alternatively, the sanitary cover may be cast with the lever opener into a single structure while being rotatably attached to the top lid by a rivet. This sanitary cover is thus rotatable between two positions, or a sanitarily covering position and a levering position. As a further alternative, the sanitary cover may be cast with the lever opener into a single structure in a manner similar to that of the second type. However, the sanitary cover of the third type is designed to be levered up at its covering position without being rotated to a separate levering position different from the second type. That is, the sanitary cover of the third type has a U-shaped lever opener part at a position around the rivet, thus effectively opening the lid when it is levered up at the covering position.

The can, with such a sanitary cover, effectively and almost completely overcomes the sanitary problem experienced in the typical beverage cans. However, it has been noted that the can regrettably has the following problems. That is, in the case of the first-type can, it is necessary to separately produce both the sanitary cover and the lever opener and to attach them on the top lid of a can using one rivet. This results in a problem in that it is very difficult to produce such cans in great quantity, and so the can fails to be produced on a commercial scale. In addition, due to the separate lever opener and the sanitary cover, the manufacturing cost of the can is increased. Another problem of the first-type can resides in that it is inconvenient to a user since the user has to separately manipulate the cover and the opener prior to emptying the can. On the other hand, the second-type can is problematic in that the sanitary cover, integrated with the lever opener, has to be rotated from a covering position to a levering position prior to breaking the opening piece along the depressed seam. This is inconvenient to a user and may allow an incorrect operation of the cover while rotating or levering the cover. In the third-type can, the opener integrated sanitary cover is designed to have a lever opener part, which levers down the opening piece of the top lid when the cover is levered up at the covering position to open the lid. However, the lever opener part is free from any reinforcing means, thus having a structural defect failing to effectively break the opening piece along the depressed seam. This allows a user to sometimes fail to open the top lid and results in an inconvenience to the user. In addition, the sanitary cover regardless of the type, disclosed in the above U.S. patent, is designed to almost completely cover the seamed rim until it covers the outside portion of said rim. Due to such a sanitary cover, it is somewhat difficult to produce the can, and so the work efficiency and productivity while producing the can is reduced.

DISCLOSURE OF THE INVENTION

Accordingly, the present invention has been made keeping in mind the above problems occurring in the prior art, and an object of the present invention is to provide a top lid for beverage cans with an opener integrated sanitary cover, the cover being primarily designed to be levered up at its covering position while opening the lid using its opener part and having a reinforcing means for improving the stiffness of the opener part, thus reliably opening the lid without failure, the cover also having a thumb-operable resilient dome capable of elastically raising a sanitary cover part of the cover over the lid when the dome is pressed down by a thumb, thus allowing a user to easily handle the cover while levering up the cover, the cover also having a reaction means for allowing the resilient dome to more effectively raise the sanitary cover part when the dome is thumb-pressed, and the cover being further designed to have a structure free from disturbing the process of manufacturing the can, thus allowing the can to be effectively produced in great quantity or on a commercial scale.

In order to accomplish the above object, the present invention provides a top lid for beverage cans with an opener integrated sanitary cover. The sanitary cover, attached to the top lid using a locking member, is designed to reach a seamed rim of the can or a position just inside the interior wall of the seamed rim of the can, or is designed to cover the area around the opening piece defined on the top lid by a depressed seam. The sanitary cover has a thumb-operable resilient dome on its sanitary cover part, thus being elastically raised up at the sanitary cover part when the dome is pressed down by a thumb. In the present invention, the resilient dome may have a hemispherical profile or another profile, such as an angled profile, modified from the hemispherical profile. In order to allow the dome to more reliably perform an elastic reaction, a reaction means is formed on or around the dome. The reaction means for the resilient dome may comprise a reaction rim formed along the outside edge of the dome, a reaction slit formed on the top portion of the dome, or a reaction nipple formed on the top portion of the dome. An opener part, used for pressing down the opening piece and breaking the piece along the depressed seam when the sanitary cover is levered up, is defined on the sanitary cover by a cutting line at an intermediate position between the locking member and the dome. The sanitary cover also has a reinforcing means for improving stiffness of the opener part, thus allowing the opener part to more effectively break the opening piece along the depressed seam without failure.

In order to open and empty a beverage can with the sanitary cover, the resilient dome is primarily pressed down by a thumb with the sanitary cover being not rotated from the covering position. When the dome is pressed down, the sanitary cover is elastically raised up at its cover part due to a reaction force of the dome, thus being spaced apart from the top lid. Therefore, it is easy for a user to grasp and handle the cover when levering up the cover to press down the opening piece using the opener part. When the cover is levered up as described above, the opener part levers down the opening piece, thus breaking the piece along the depressed seam. The above opener part is provided with a reinforcing means, such as a reinforcing rib having a first folded and compact rectangular cross-section, a second reinforcing rib having an arcuate cross-section, or a rugged pattern, thus having an improved stiffness. Therefore, the opener part reliably breaks the opening piece along the depressed seam without failure regardless of an interior pressure acting on the opening piece.

The thumb-operable resilient dome of this invention may be preferably used with a conventional lever opener attached to the top lid. In such a case, the lever opener is elastically raised up when the dome is pressed down by a thumb. Therefore, it is easy for a user to grasp and handle the opener while levering up the opener to open the top lid of the can.

In an embodiment of this invention, a thumb-operable resilient dome is formed on the sanitary cover, while an arcuate cutting line is formed at an intermediate portion of the sanitary cover between the locking member and the dome, thus forming the opener part. In addition, a depressed bending line is formed on the sanitary cover while transversely and linearly extending outwardly from each end of the cutting line to the outside edge of the cover. The sanitary cover is thus bendable along said bending line when the cover is levered up. The above opener part has a reinforcing means, such as a reinforcing rib having a first folded and compact rectangular cross-section, a second reinforcing rib having an arcuate cross-section, or a rugged pattern, thus having an improved stiffness. The opener part thus reliably breaks the opening piece along the depressed seam without failure.

In the present invention, the sanitary cover may be designed to reach the seamed rim of the can. However, it is more preferable to design the sanitary cover to have a compact size reaching a position just inside the interior wall of the seamed rim or covering the area around the opening piece since such a sanitary cover allows the beverage cans to be produced in great quantity or on a commercial scale.

The sanitary cover of this invention may be attached to the top lid using two or more locking members. In addition, it is possible to change the length and width of the sanitary cover in accordance with the designing conditions of the can. The thumb-operable resilient dome may be somewhat freely designed if the dome reliably performs an elastic reaction capable of raising the sanitary cover when the dome is pressed down by a thumb. The configuration and arrangement of the reinforcing ribs formed on the opener part may be freely changed in accordance with the designing conditions of the can, or the interior pressure acting on the opening piece and the size of the can.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* to 1*e* are views of the top lid of a can provided with a sanitary cover in accordance with the primary embodiment of the present invention, in which FIGS. 1*a* to 1*c* are a perspective view, a plan view, and a sectional view of the lid with the cover closely covering the lip contact portion of the lid by its cover part, and FIGS. 1*d* and 1*e* are sectional views of the top lid with a thumb-operable resilient dome of the cover being pressed down to elastically raise the cover part;

FIGS. 18*m* to 18*q* are cross-sectional views, individually showing the construction of both a thumb-operable resilient dome of a can opener and a top lid of a can in accordance with an embodiment of this invention;

BEST MODE FOR CARRYING OUT THE INVENTION

Figure 1A:
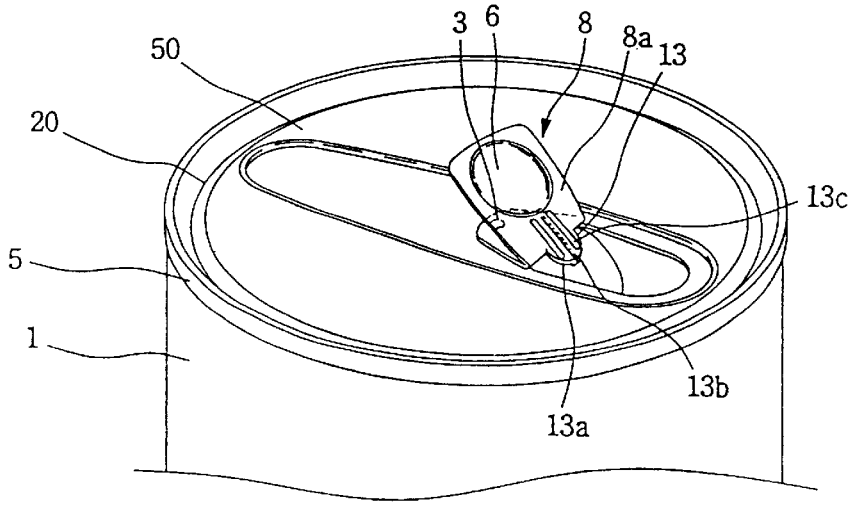

FIGS. 1*a* to 1*e* are views, showing the top lid of a can provided with a sanitary cover in accordance with the primary embodiment of this invention. As shown in the drawings, a sanitary cover 8 is attached to the top lid 50 of a beverage can using a locking member 3 and is adapted for keeping the lip contact portion of the top lid 50 sanitary during storage of the can.

The sanitary cover 8 comprises a thin plate body 8*a*. The thin plate body 8a, having a sanitary cover part at an outside end portion thereof, is exteriorly attached to the top lid 50 at an inside end portion thereof using the locking member 3 in a way such that the cover 8 completely covers the opening piece 3*a*, defined on the top lid 50 by a depressed seam 3*c*. The cover 8 also covers the lip contact portion around the opening piece 3*a* by its sanitary cover part.

A thumb-operable resilient dome 6 is formed on the sanitary cover part of the thin plate body 8*a* and is adapted for elastically raising the cover part above the top lid 50 when the dome 6 is pressed down. An opener part 13 is defined on the thin plate body 8*a* by a U-shaped depressed cutting line 24 at an intermediate position between the locking member 3 and the dome 6. The above opener part 13 thus has a U-shaped profile projecting toward the locking member 3. A depressed bending line 10 is formed on the thin plate body 8*a* while transversely and linearly extending outwardly from each end of the U-shaped depressed cutting line 24 to the outside edge of the thin plate body 8*a*. The thin plate body 8*a* is thus bendable along the two bending lines 10 when the cover 8 is levered up so as to break the opening piece 3*a* along the depressed seam 3*c*.

The sanitary cover 8 also has a reinforcing means for improving stiffness of the U-shaped opener part 13, thus allowing the opener part 13 to more reliably break the opening piece 3*a* along the depressed seam 3*c* without failure. In the primary embodiment, the reinforcing means comprises one center reinforcing rib 13*b* and two side reinforcing ribs 13*c*. Of the three reinforcing ribs 13*b* and 13*c*, the center rib 13*b*, having a folded and compact rectangular cross-section, extends along the central axis of the opener part 13 from the outside edge 13*a* of the part 13 to the edge of the dome 6. On the other hand, the two side ribs 13*c*, individually having an arcuate cross-section, extend from the outside edge 13*a* of the part 13 to the edge of the dome 6 at both sides of the center rib 13*b*. The two side ribs 13*c* are parallel to the center rib 13*b*.

The sanitary cover 8 also has a first reaction means for allowing the dome 6 to more effectively perform a desired resilient reaction when the dome 6 is pressed down by a thumb. In the primary embodiment, the first reaction means comprises an annular reaction rim 6*a* which is formed along the outside edge of the resilient dome 6.

Figure 1B:
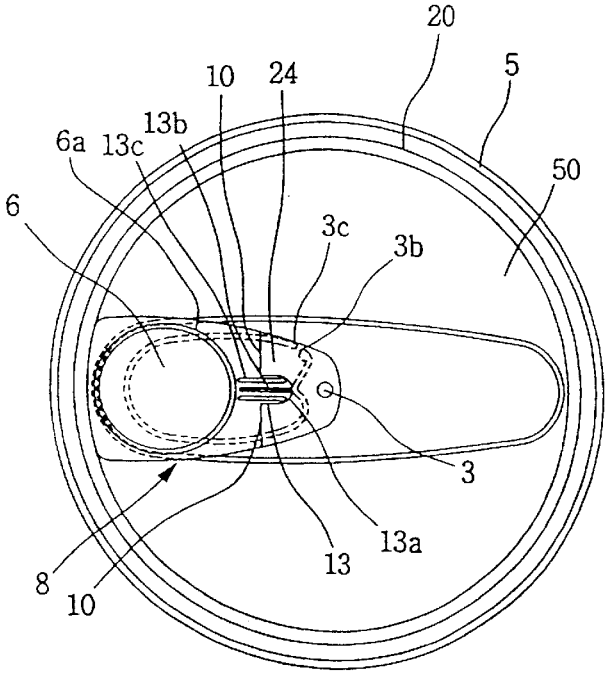
Figure 1C:
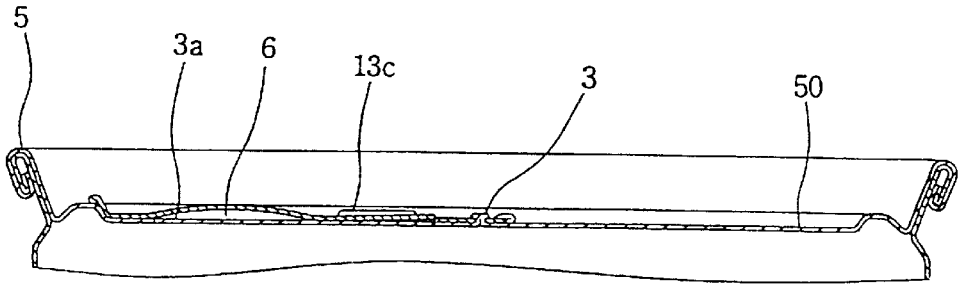
Figure 1D:
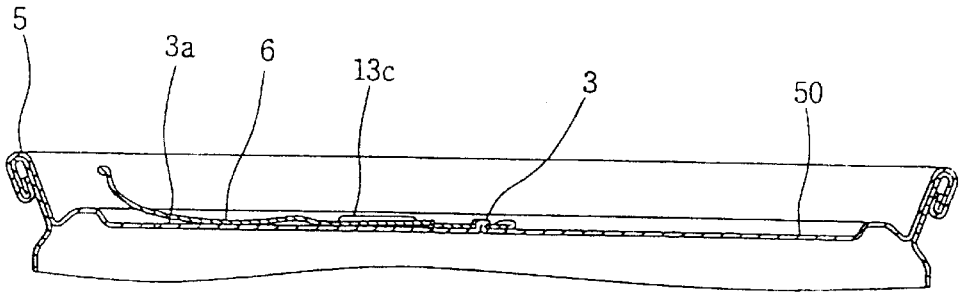
Figure 1E:
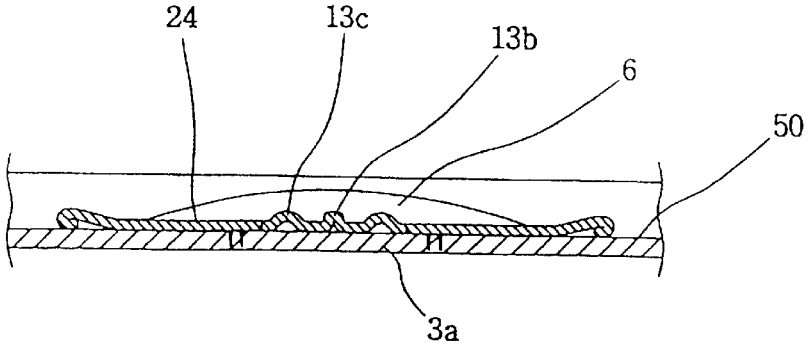
Figure 1F:
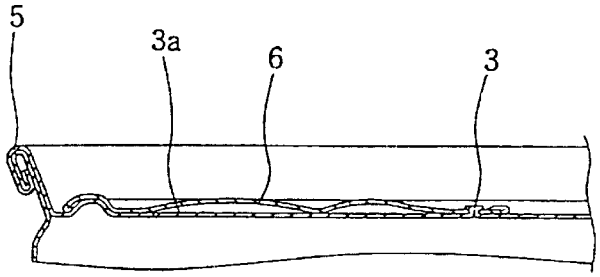
FIGS. 1*f* to 1*j* are sectional views of top lids provided with sanitary covers in accordance with further embodiments of this invention.
Figure 1G:
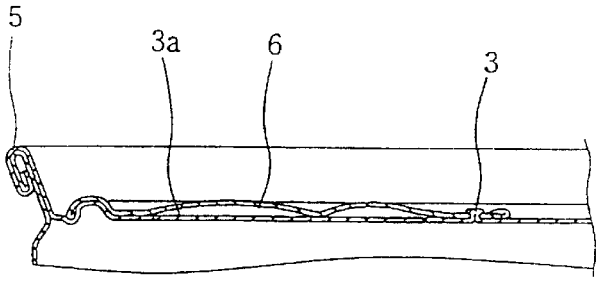
Figure 1H:
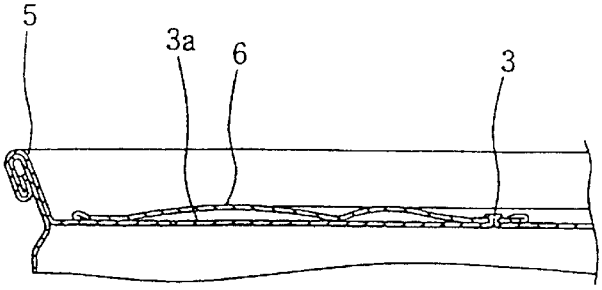
Figure 1I:
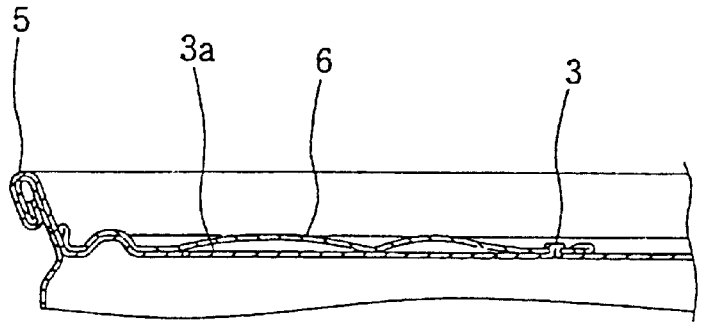
Figure 1J:
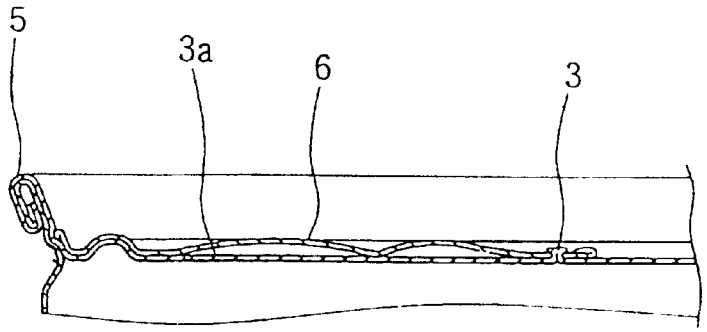

In the present invention, the sanitary cover 8 may be designed to only cover the area around the opening piece 3*a* as shown in FIGS. 1*b* and 1*c*. Alternatively, the sanitary cover 8 may be designed to further extend until it reaches a position just inside the interior wall 20 of the seamed rim 5 and rests in the annular groove of the top lid as shown in FIG. 1*f*. As well known to those skilled in the art, the above rim 20 seams the junction between the top lid 50 and the sidewall of the can. As a further alternative, the sanitary cover 8 may be designed to reach a position just inside the interior wall 20 of the seamed rim 5, with the outside edge of the cover 8 being closely seated in a seating groove formed on the sidewall of the annular groove of the top lid at a position just inside the interior wall 20 as shown in FIG. 1*g*. In such a case, the outside edge of the cover 8 is inserted into the seating groove of the top lid 50 to a length equal to the thickness of the cover 8. The sanitary cover 8 of FIG. 1*g* thus gives a compact appearance to the top lid 50 and improves work efficiency while producing the can. In another embodiment, the top lid 50 may be designed to be free from any annular groove at a position inside the interior wall 20 of the rim 5 as shown in FIG. 1*h*. In such a case, the outside edge of the cover 8 forms a space between the edge of the cover 8 and the interior wall 20 of the rim 5. In a further embodiment, the sanitary cover 8 may further extend until it reaches a middle portion of the interior wall 20 of the seamed rim 5 as shown in FIG. 1*i*. In still another embodiment, the sanitary cover 8 may be designed to reach the middle portion of the interior wall 20 of the seamed rim 5, with the outside edge of the cover 8 being closely seated in a seating groove formed on the interior wall 20 as shown in FIG. 1*j*. In such a case, the outside edge of the cover 8 is inserted into the seating groove of the interior wall 20 to a length equal to the thickness of the cover 8. The sanitary cover 8 of FIG. 1*j* gives a compact appearance to the top lid 50 and improves work efficiency while producing the can in the same manner as that described for the embodiment of FIG. 1*g*.

As described above, both the center reinforcing rib 13*b* and the two side reinforcing ribs 13*c*, formed on the U-shaped opener part 13, individually extend from the outside edge 13*a* of the opener part 13 to a position just outside the edge of dome 6. In order to further improve the stiffness of the U-shaped opener part 13, the three reinforcing ribs 13*b* and 13*c* may further extend until they completely reach the dome 6. In the primary embodiment, the three reinforcing ribs 13*b* and 13*c* are designed to project upwardly. However, it should be understood that the three reinforcing ribs 13*b* and 13*c* may be designed to project downwardly without affecting the functioning of the reinforcing ribs. When two or more reinforcing ribs are formed on the U-shaped opener part 13 as disclosed in the primary embodiment, some of the reinforcing ribs may be designed to project upwardly with the other ribs projecting downwardly. In such a case, it is more preferable to design the reinforcing ribs to alternately project upwardly and downwardly.

In the primary embodiment, the center rib 13*b* is formed by primarily projecting the U-shaped opener part 13 upwardly along the central axis of the part 13, thus giving an arcuate cross-section to the rib 13*b*. Thereafter, the rib 13*b* is compressed at both sidewalls, thus having a folded and compact rectangular cross-section as described above. The center rib 13*b* may be thus so-called a folded rib. In accordance with a compression force applied to the rib 13*b*, the folded cross-section of the rib 13*b* may become a triangular cross-section or a tightly compressed cross-section. In the primary embodiment, only one folded rib 13*b* is formed on the U-shaped opener part 13. However, it should be understood that two or more folded ribs 13*b* may be formed on the opener part 13 so as to further improve the stiffness of the opener part 13. The U-shaped opener part 13, with two or more folded ribs 13*b*, may be preferably used with a highly pressurized can.

Figure 2A:
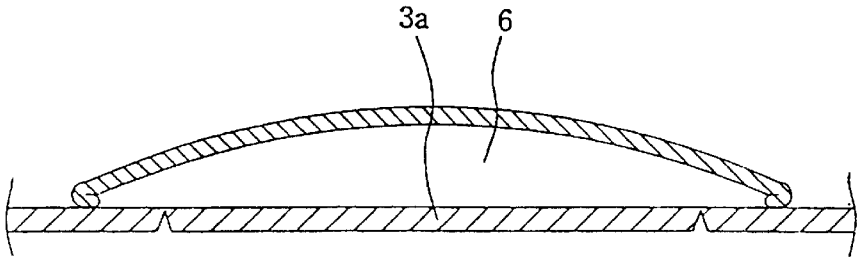
FIGS. 2*a* to 2*c* are sectional views of top lids, respectively showing embodiments of the thumb-operable resilient dome formed on the sanitary cover of this invention.
Figure 2B:
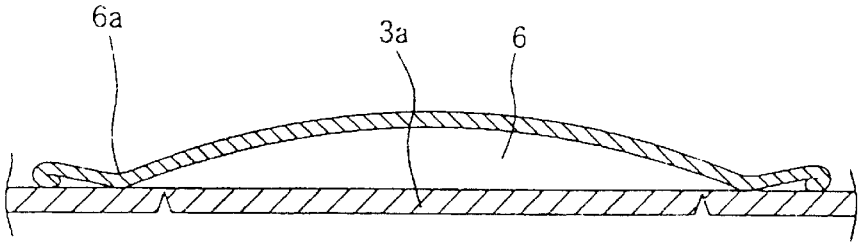
Figure 2C:
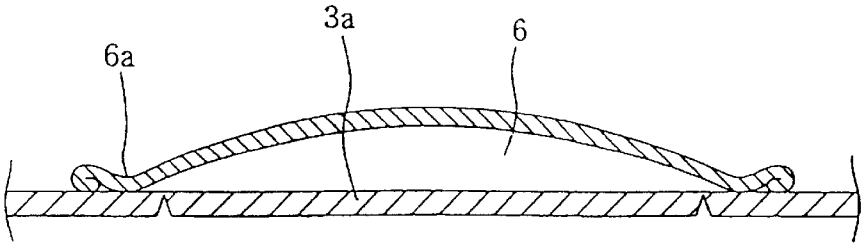

In the present invention, the thumb-operable resilient dome 6 may have a simple domed configuration without having any reaction rim 6*a* as shown in FIG. 2*a*. However, it is more preferable to continuously form a reaction rim 6*a*, having an appropriate width, along the outside edge of the resilient dome 6 as shown in FIGS. 2*b* and 2*c*. Such a reaction rim 6*a* allows the dome 6 to more effectively perform a resilient reaction when the dome 6 is pressed down by a thumb.

In order to open and empty a beverage can with the above-mentioned sanitary cover 8, the resilient dome 6 is primarily pressed down by a thumb. The position of the sanitary cover 8 is changed from the closed position of FIG. 1*c* to a raised position of FIG. 1*d*. That is, the cover part of the sanitary cover 8 is elastically raised up due to a reaction force of the dome 6, thus being spaced apart from the top lid 50 as shown in FIG. 1*d*. Therefore, it is easy for a user to grasp and handle the cover 8 when levering up the cover 8 to press down the opening piece 3*a* using the opener part 13. When the cover 8 is levered up as described above, the cover 8 is bent up along the two bending lines 10 as shown in FIG. 1*a*, with the U-shaped and reinforced opener part 13 to press down the opening piece 3*a*. The opening piece 3*a* is thus broken along the depressed seam 3*c*. In such a case, the depressed seam 3*c* is not continuously formed around the opening piece 3*a*, but has a bridge 3*b* at a position around the locking member 3. Therefore, when the opening piece 3*a* is fully pressed down by the opener part 13 of the cover 8, the piece 3*a* is not removed from the top lid 50, but is still connected to the top lid 50. At any rate, the opening piece 3*a* forms an opening defined by the seam 3*c*, thus allowing the user to empty the can.

Figure 3A:
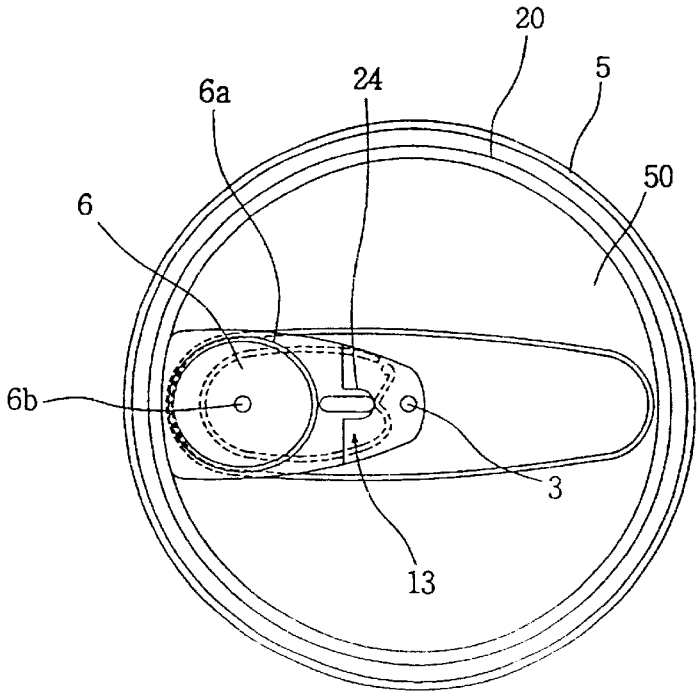
FIGS. 3*a* to 3*c* are sectional views, respectively showing embodiments of the thumb-operable resilient dome of this invention.
Figure 3B:
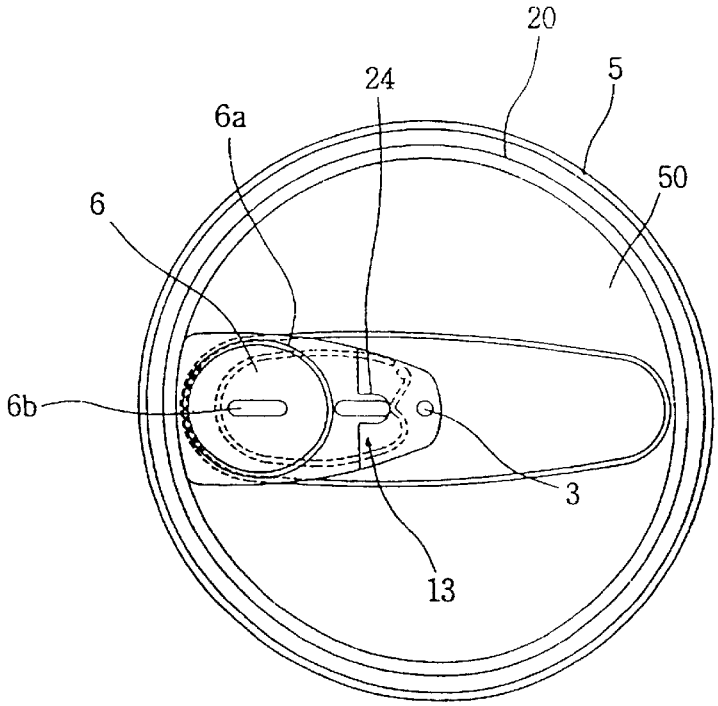
Figure 3C:
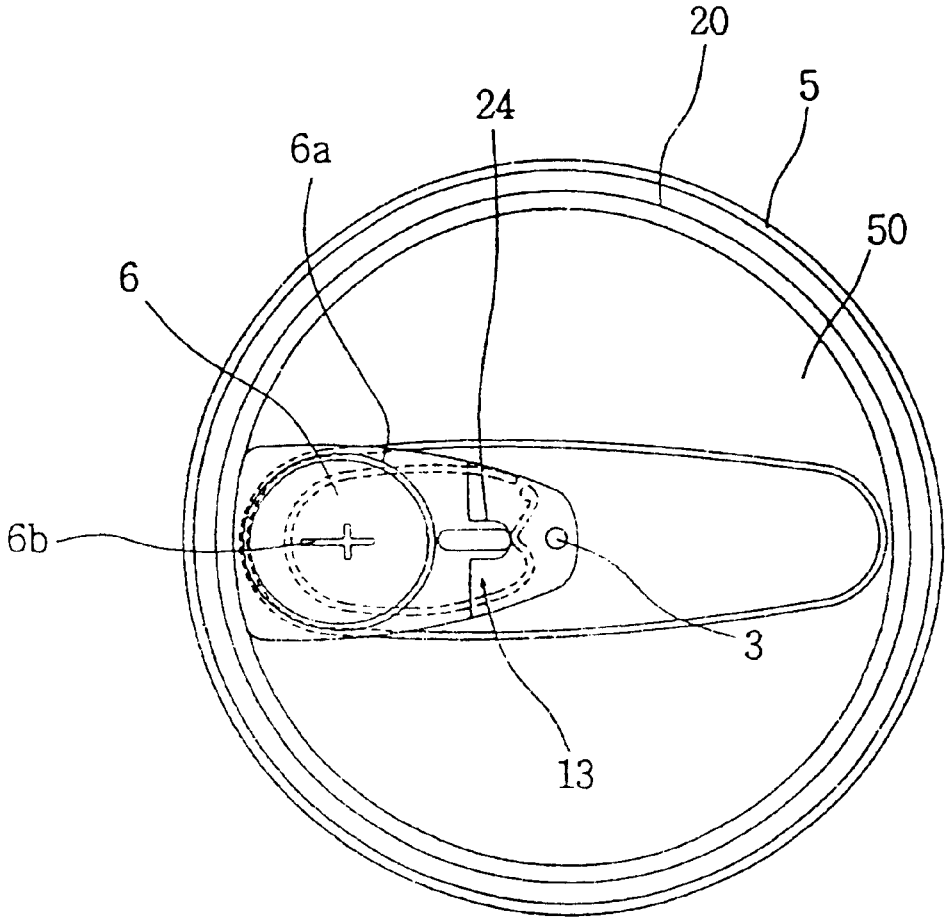
Figure 5A:
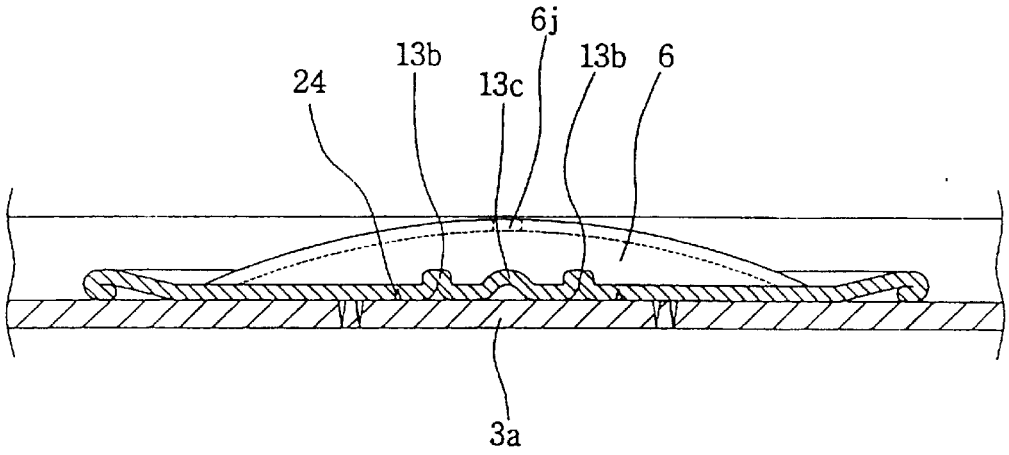
FIGS. 5*a* and 5*b* are sectional views, respectively showing other embodiments of the thumb-operable resilient dome of this invention.
Figure 5B:
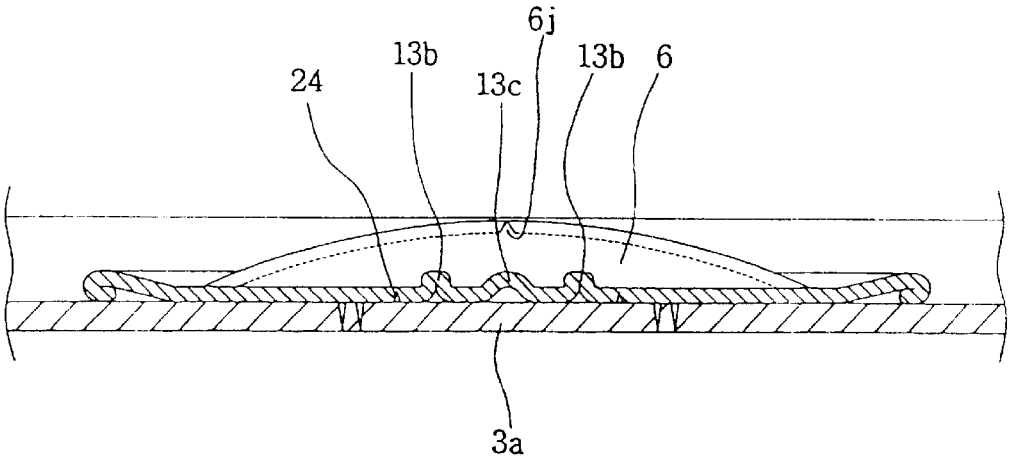

In accordance with still another embodiment of this invention, a second reaction means, or a reaction slit 6*b* may be formed on the top portion of the thumb-operable resilient dome 6 as shown in FIGS. 3*a* to 3*c*. Such a second reaction means 6*b* allows the dome 6 to more effectively perform a resilient reaction when the dome 6 is pressed down by a thumb in the same manner as that described for the first reaction means 6*a*. The second reaction means 6*b* may have any profile, such as a circular, a slot-shaped or a cross-shaped profile, if the profile allows the dome 6 to more effectively perform a resilient reaction. The second reaction means 6*b* may be formed in a way such that the top portion of the dome 6 is completely penetrated as shown in FIG. 5*a*, thus forming an opening 6*i*. Alternatively, the second reaction means 6*b* may be formed in a way such that the top portion of the dome 6 is slitted as shown in FIG. 5*b*, thus forming a slit 6*j*. In addition, the second reaction means 6*b* may be formed by irregularly embossing and depressing the top portion of the dome 6.

Figure 4A:
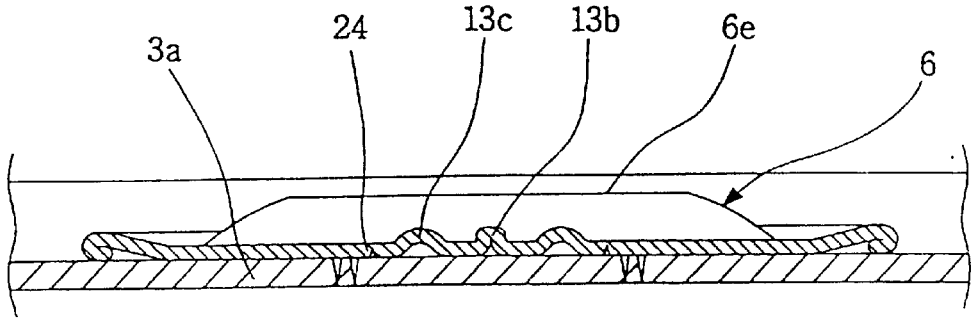
FIGS. 4*a* to 4*d* are sectional views, respectively showing additional embodiments of the thumb-operable resilient dome of this invention.
Figure 4B:
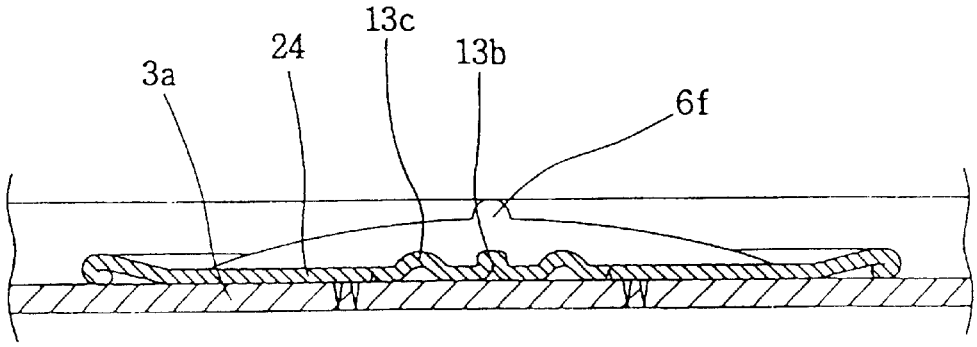
Figure 4C:
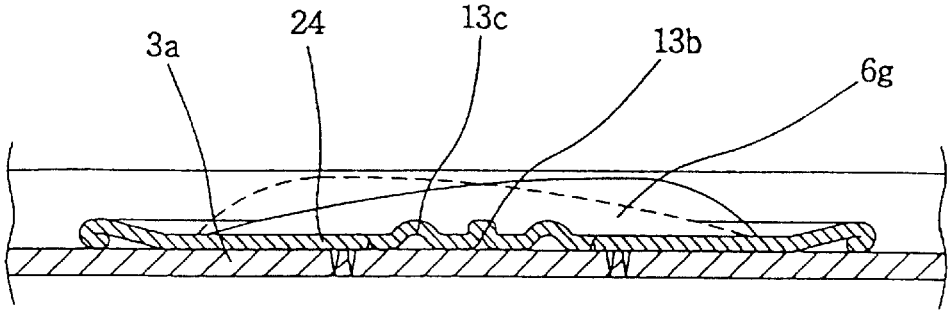
Figure 4D:
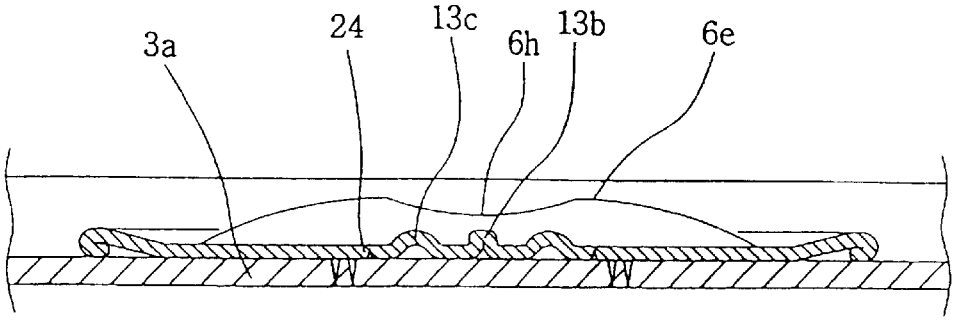

In accordance with still another embodiment of this invention, the rounded top portion of the thumb-operable resilient dome 6 may be changed into another configuration as shown in FIGS. 4*a* to 4*d*. In the embodiment of FIG. 4*a*, the top portion of the dome 6 is designed to be flat, thus having a flat surface 6*e*. In the embodiment of FIG. 4*b*, the top portion of the dome 6 is designed to have a nipple 6*f* at the top center. In the embodiment of FIG. 4*c*, the top portion of the dome 6 is designed to be slanted to a side, thus having a slanted surface 6*g*. In the embodiment of FIG. 4*d*, the top portion of the dome 6 is designed to have a smoothly depressed surface 6*h* at the top center. The flat top surface 6*e*, the nipple 6*f*, the slanted surface 6*g*, or the depressed top surface 6*h* improves the resilient reaction of the dome 6.

Figure 6A:
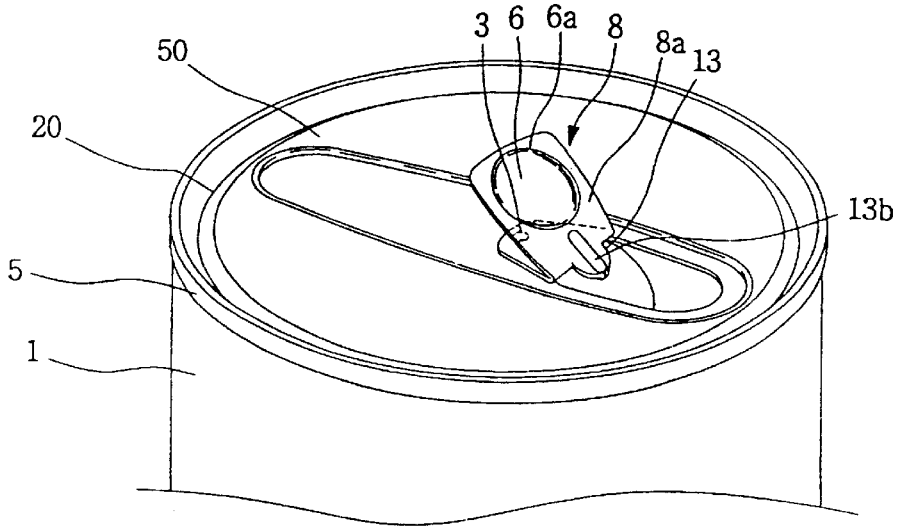
FIGS. 6*a* and 6*b* are a perspective view and a plan view of the top lid of a can provided with a sanitary cover in accordance with still another embodiment of the present invention.
Figure 6B:
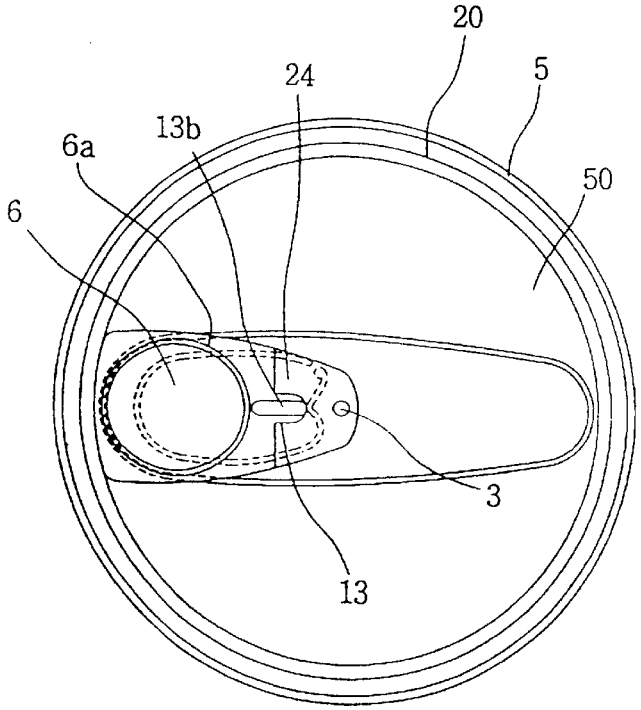

In still another embodiment, the reinforcing means of the U-shaped opener part 13 may comprise only one folded rib 13*b* formed along the central axis of the opener part 13 as shown in FIGS. 6*a* and 6*b*. The sanitary cover 8, having such a single reinforcing rib 13*b* at the U-shaped opener part 13, may be used with a lowly pressurized can, for example, a can filled with beverage other than carbonated drink. Such a single reinforcing rib 13*b* simplifies the production process and reduces the production cost of the sanitary cover 8. This results in a reduction in the production cost of the beverage cans.

Figure 7:
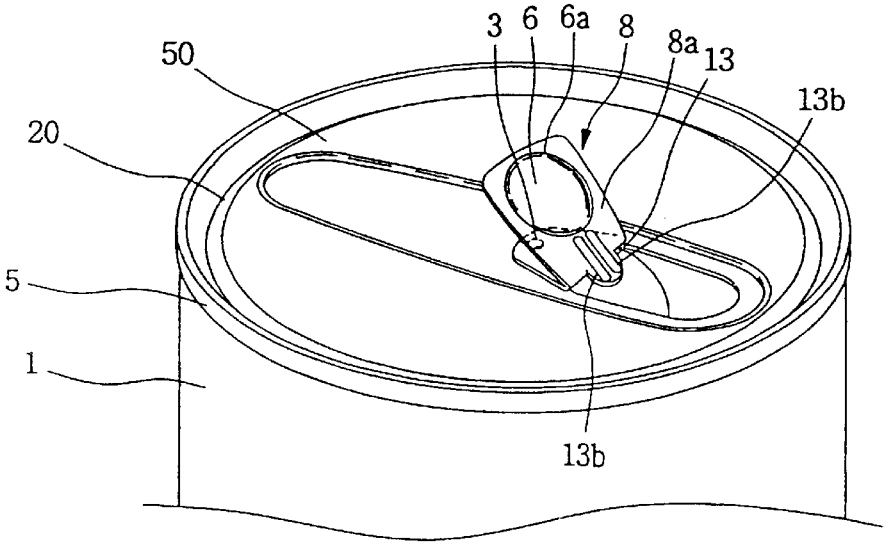
FIG. 7 is a perspective view of the top lid of a can provided with a sanitary cover in accordance with still another embodiment of the present invention.

In a further embodiment, the reinforcing means of the U-shaped opener part 13 may comprise two folded ribs 13*b* extending in parallel to each other as shown in FIG. 7. The two reinforcing ribs 13*b* further improve the stiffness of the U-shaped opener part 13 in comparison with the embodiment of FIGS. 6*a* and 6*b*, thus being preferably used with a can pressurized higher than that of FIGS. 6*a* and 6*b*.

Figure 8:
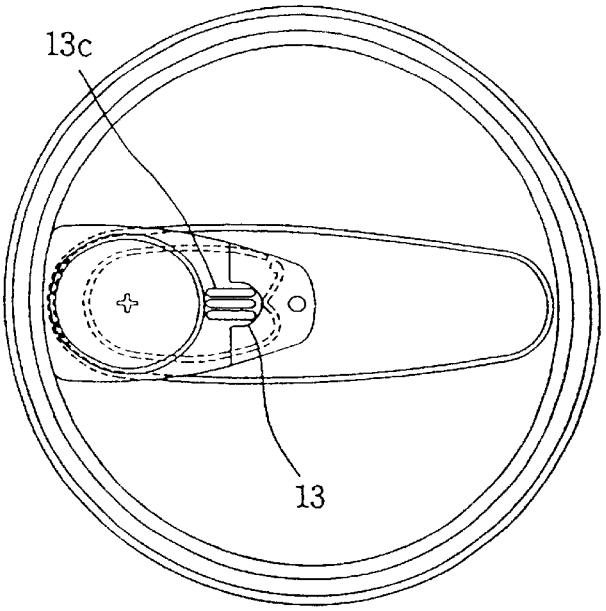
FIG. 8 is a plan view of the top lid of a can provided with a sanitary cover in accordance with still another embodiment of the present invention.

As a further alternative, the reinforcing means of the U-shaped opener part 13 may comprise three rounded ribs 13*c* extending in parallel to each other as shown in FIG. 8.

As described above, it is possible to freely design the reinforcing means for the U-shaped opener part 13 in accordance with the interior pressure acting on the opening piece 3*a* of the top lid 50.

Of course, it should be understood that the number and arrangement of the reinforcing ribs 13*b* and 13*c* may be somewhat freely changed without affecting the function of this invention. For example, the reinforcing means for the opener part 13 may comprise a plurality of folded ribs 13*b* without having any rounded ribs 13*c*. Alternatively, the reinforcing means for the opener part 13 may comprise one or more folded ribs 13*b* and one or more rounded ribs 13*c* in a way such that three or more reinforcing ribs 13*b* and 13*c* are alternately arranged on the U-shaped opener part 13. In a brief description, the reinforcing means for the opener part 13 may be freely designed in accordance with the size of an objective can, the interior pressure of the can, and the size of the opener part 13 relative to the opening piece 3*a*.

Figure 9:
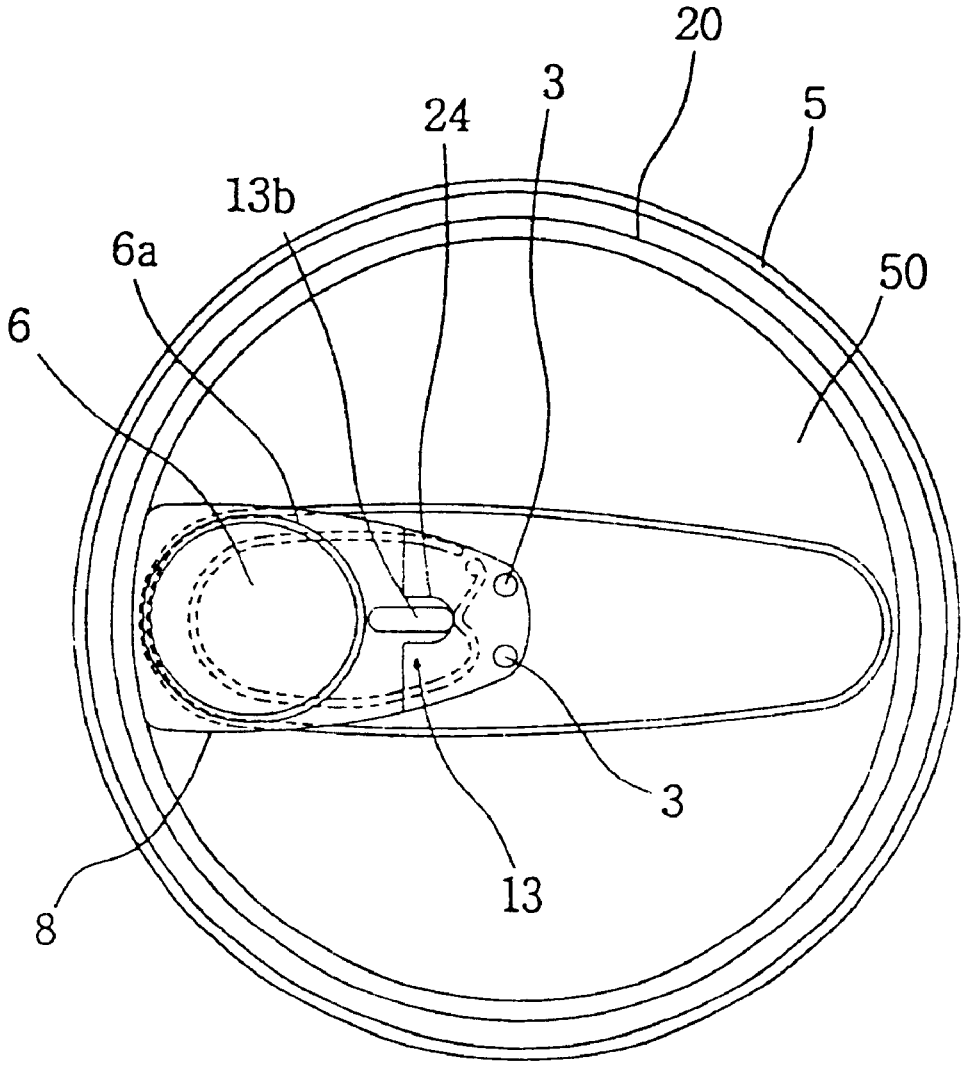
FIG. 9 is a plan view of the top lid of a can provided with a sanitary cover in accordance with still another embodiment of the present invention.

In still another embodiment, the sanitary cover 8 of this invention may be attached to the top lid 50 using two or more locking members 3 as shown in FIG. 9. This embodiment increases the locking force between the sanitary cover 8 and the top lid 50, thus being preferably used with a large-sized can. The two or more locking members 3 also prevent the sanitary cover 8 from being undesirably displaced.

Figure 10:
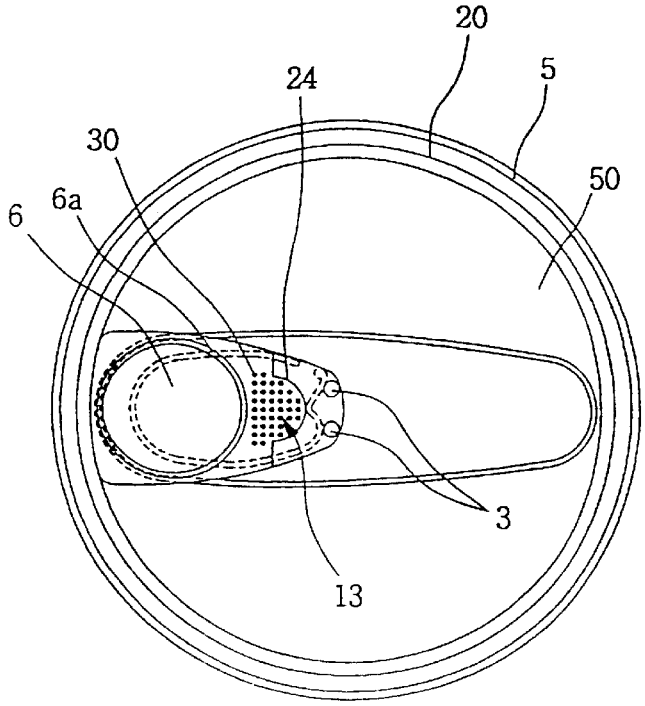
FIG. 10 is a plan view of the top lid of a can provided with a sanitary cover in accordance with still another embodiment of the present invention.
Figure 11:
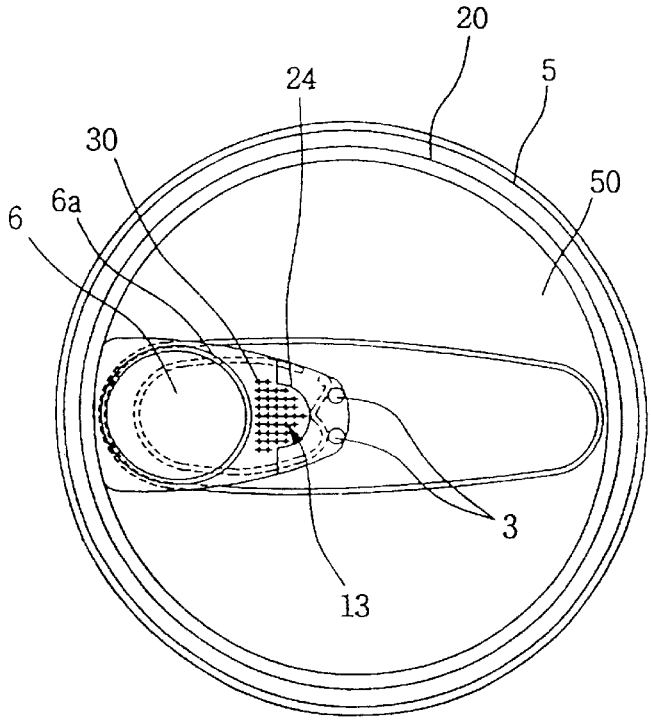
FIG. 11 is a plan view of the top lid of a can provided with a sanitary cover in accordance with still another embodiment of the present invention.

In the present invention, a rugged pattern 30, comprising a plurality of embossments and/or depressions, may be formed on the U-shaped opener part 13 of the sanitary cover 8 as shown in FIGS. 10 and 11. The embossments and/or depressions of the rugged pattern 30 may have a circular, a T-shaped, an L-shaped, a U-shaped, a cross-shaped, or an I-shaped profile. Of course, it should be understood that the rugged pattern 30 may be formed with embossments and/or depressions of the above-mentioned shapes being mixedly arranged on the opener part 13.

Figure 12A:
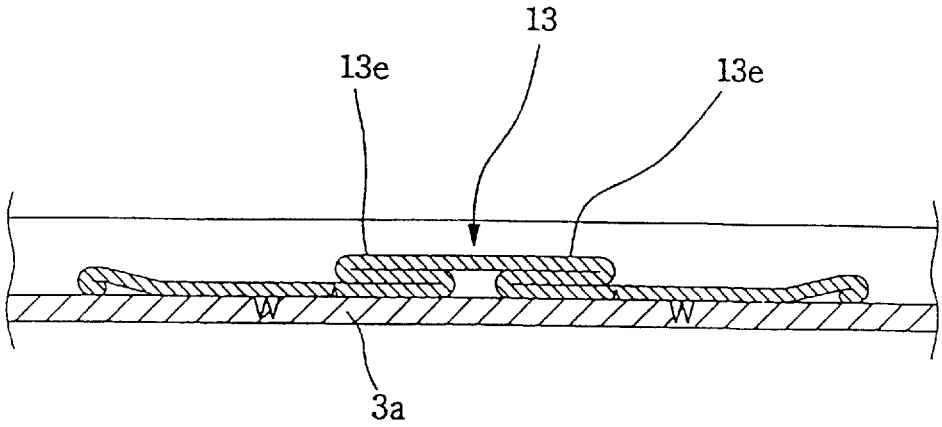
FIGS. 12*a* to 12*c* are sectional views, respectively showing embodiments of a reinforced opener part formed at the sanitary cover of this invention.
Figure 12B:
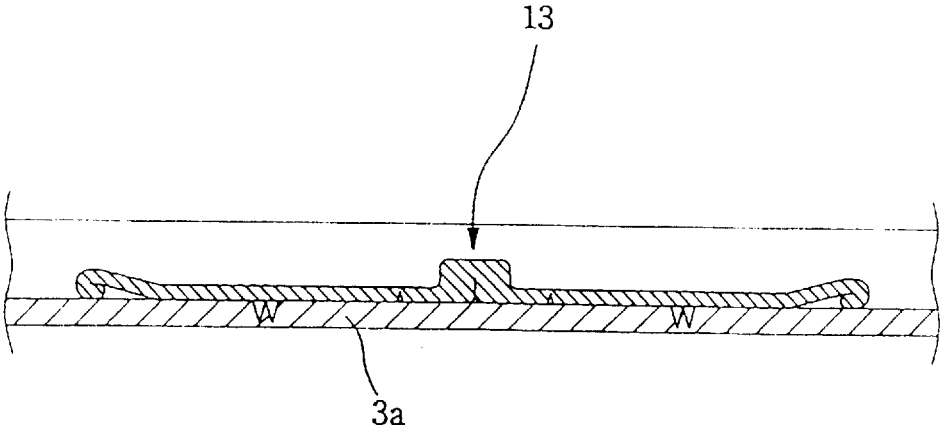
Figure 12C:
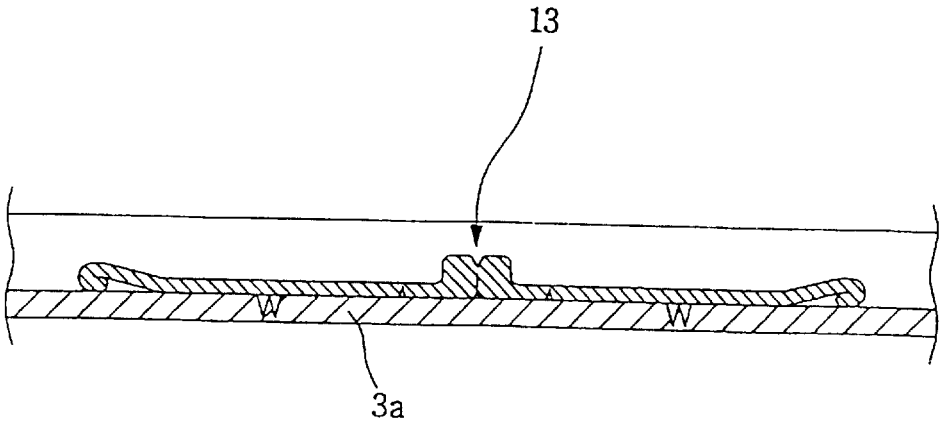

In still another embodiment, the opener part 13 may be raised up along the central axis prior to being flatly pressed down, thus forming a reinforcing rib with a double-folded edge 13*e* being formed at each side edge of the rib as shown in FIG. 12*a*. Due to the double-folded edges 13*e*, the reinforcing rib improves the stiffness of the opener part 13 and allows the opener part 13 to reliably break the opening piece 3*a* along the depressed seam 3*c*. Alternatively, the U-shaped opener part 13 may be raised up along the central axis prior to being compressed at both sides, thus forming a folded rib having a compact rectangular cross-section as shown in FIG. 12*b*. As a further alternative, an axial groove may be formed along the central axis of the folded rib of FIG. 12*b*. The opener part 13, with such an axial groove, is shown in FIG. 12*c*. The strength of the opener part 13 of FIG. 12*c* is higher than that of FIG. 12*b*.

Figure 13:
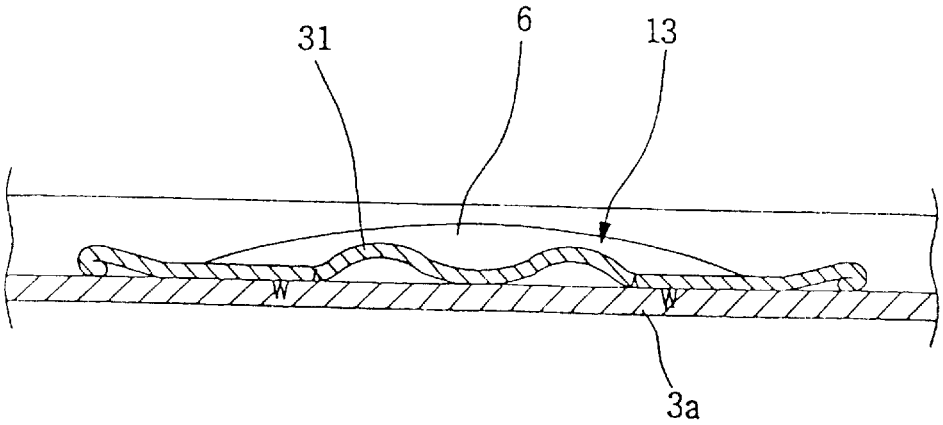
FIG. 13 is a sectional view, showing another embodiment of the reinforced opener part.

In a further embodiment, the U-shaped opener part 13 may be designed to have a waved cross-section as shown in FIG. 13. In the embodiment of FIG. 13, the opener part 13 has two ridges 31 with one furrow being formed between the two ridges 31. Even though such ridges 31 fail to have the same complete configuration as that of the two side reinforcing ribs 13*c* of FIG. 1*e*, the ridges 31 effectively reinforce the U-shaped opener part 13 and allow the opener part 13 to reliably break the opening piece 3*a* along the depressed seam 3*c*.

Figure 14A:
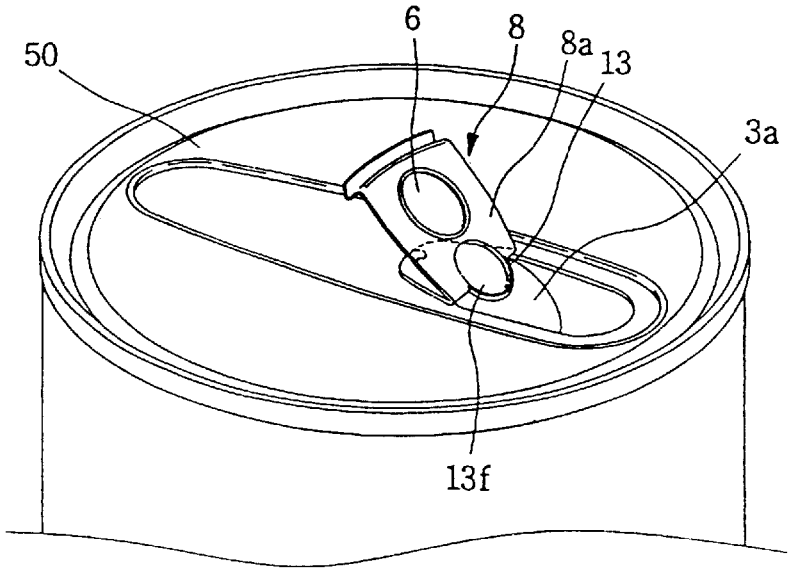
FIGS. 14*a* and 14*b* are a perspective view and a sectional view, showing still another embodiment of the reinforced opener part.
Figure 14B:
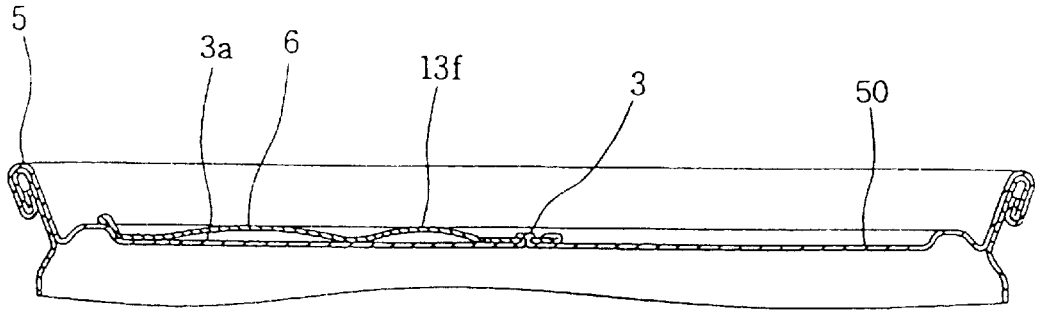
Figure 14C:
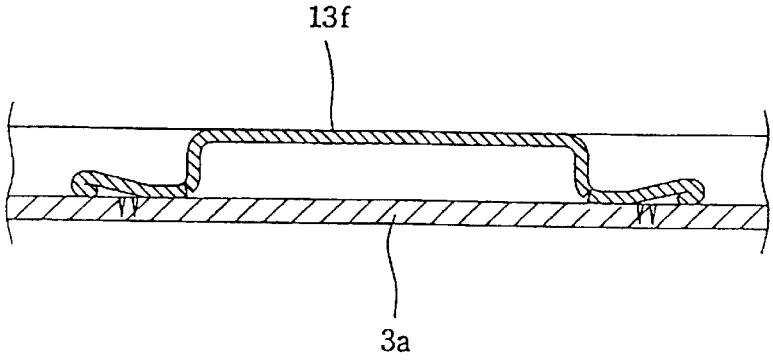
FIGS. 14*c* and 14*d* are sectional views, respectively showing further embodiments of the reinforced opener part.
Figure 14D:
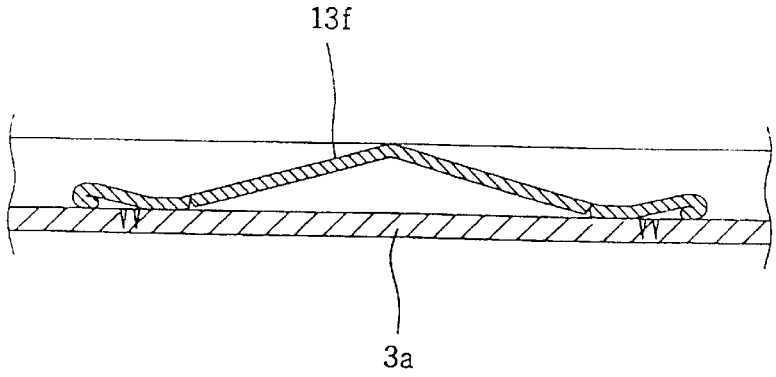

In still another embodiment, the reinforcing means for the U-shaped opener part 13 may comprise a reinforcing dome 13*f* as shown in FIGS. 14*a* and 14*b*. In this embodiment, the reinforcing dome 13*f* is formed on the opener part 13 with the outside edge of the dome 13*f* reaching the edge of the part 13 and a position just outside the reaction rim of the resilient dome 6. The outside edge of the reinforcing dome 13*f* may have a circular or an oval configuration. In a further embodiment, the reinforcing dome 13*f* of the opener part 13 may be shaped as an angled dome as shown in FIGS. 14*c* and 14*d*. The reinforcing dome 13*f* according to the embodiment of FIG. 14*c* has a rectangular cross-section, while the reinforcing dome 13*f* according to the embodiment of FIG. 14*d* has a triangular cross-section. Such an angled reinforcing dome of FIG. 14*c* or 14*d* more effectively reinforces the opener part 13 than the rounded reinforcing dome of FIGS. 14*a* and 14*b*, thus being preferably used with a can which is highly pressurized and forces the opener part 13 to have a higher strength.

Figure 15:
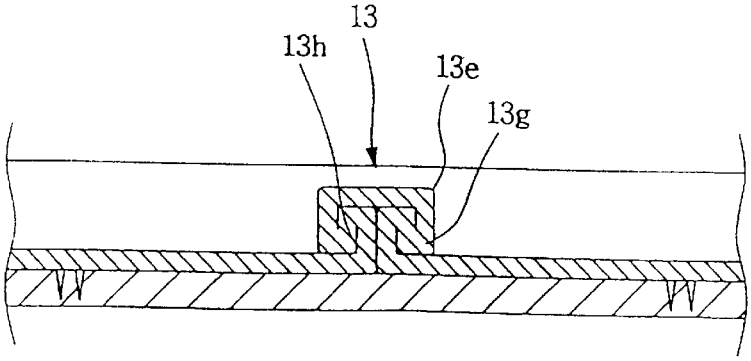
FIG. 15 is a sectional view, showing still another embodiment of the reinforced opener part.

FIG. 15 shows a reinforcing means for the U-shaped opener part 13 in accordance with still another embodiment of this invention. In this embodiment, the opener part 13 is raised up along the central axis prior to being flat pressed down, thus forming a reinforcing rib with a double-folded edge 13*e* being formed at each side edge of the rib. That is, each edge 13*e* is primarily folded at a portion 13*g*, and is secondarily folded at a portion 13*h*, thus having a double-folded cross-section. The above double-folded reinforcing rib further improves the stiffness of the opener part 13 in comparison with the single-folded rib 13*b*, thus being preferably used with a highly pressurized can.

Figure 16:
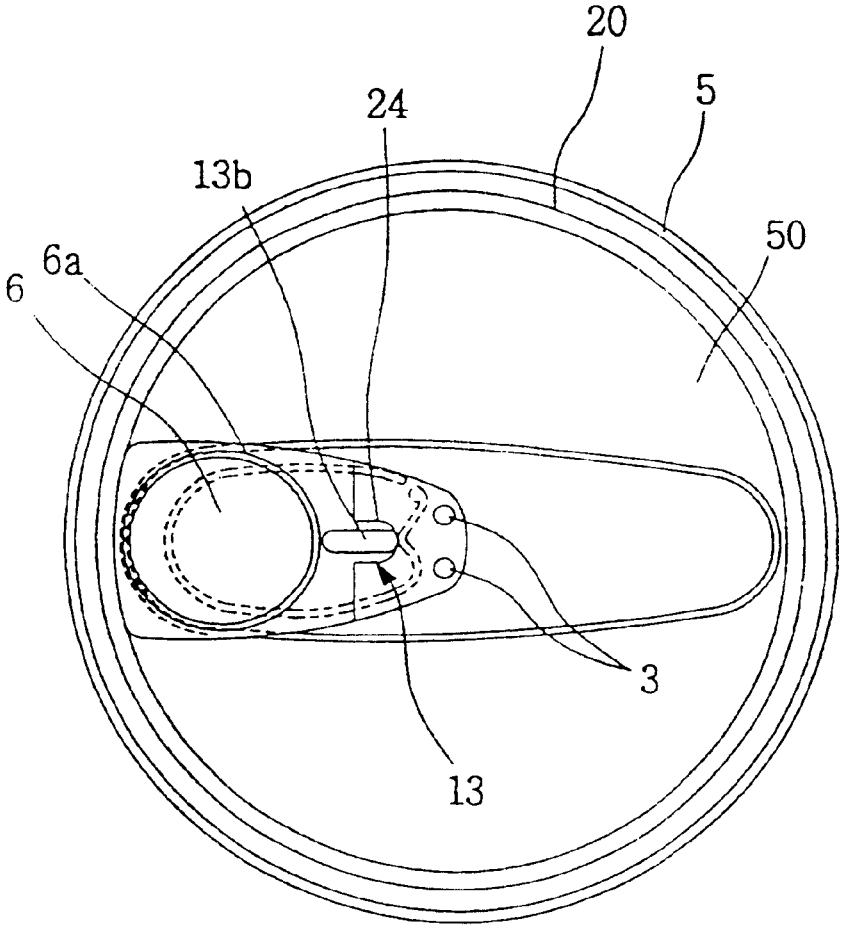
FIG. 16 is a plan view, showing the top lid of a can provided with a sanitary cover in accordance with still another embodiment of the present invention.

The depressed cutting line 24, defining the U-shaped opener part 13 on the sanitary cover 8, is formed on the sanitary cover 8 at an intermediate portion between the locking member 3 and the dome 6 as shown in FIG. 16. The above cutting line 24 may be completely cut, thus reliably forming the opener part 13 when the sanitary cover 8 is levered up so as to break the opening piece 3*a* along the depressed seam 3*c*. Alternatively, the cutting line 24 may be depressed without being completely cut, thus forming a depressed seam capable of keeping the lip contact portion around the opening piece 3*a* sanitary during storage of the can. In addition, the cutting line 24 may be formed by pressing the sanitary cover 8 from the lower surface of the cover 8, thus having a reversed V-shaped cross-section. Alternatively, the cutting line 24 may be formed by pressing the sanitary cover 8 from the upper surface of the cover 8, thus having an upright V-shaped cross-section. In the present invention, the cutting line 24 may have a U-shaped profile or another profile modified from the U-shaped profile. Since the outside edge of the sanitary cover 8 is rolled so as to form a rounded and smooth edge free from undesirably injuring the fingers of a user, the depressed bending line 10 of the sanitary cover 8 may fail to be easily bent at the rolled outside edge of the cover 8 when the cover 8 is levered up. In order to overcome the above problem, the depressed bending line 10 may be partially cut at the rolled outside edge during the manufacturing process of the can. This allows the sanitary cover 8 to be easily bent along the depressed bending line 10 when the cover 8 is levered up to break the opening piece 3*a*.

Figure 17:
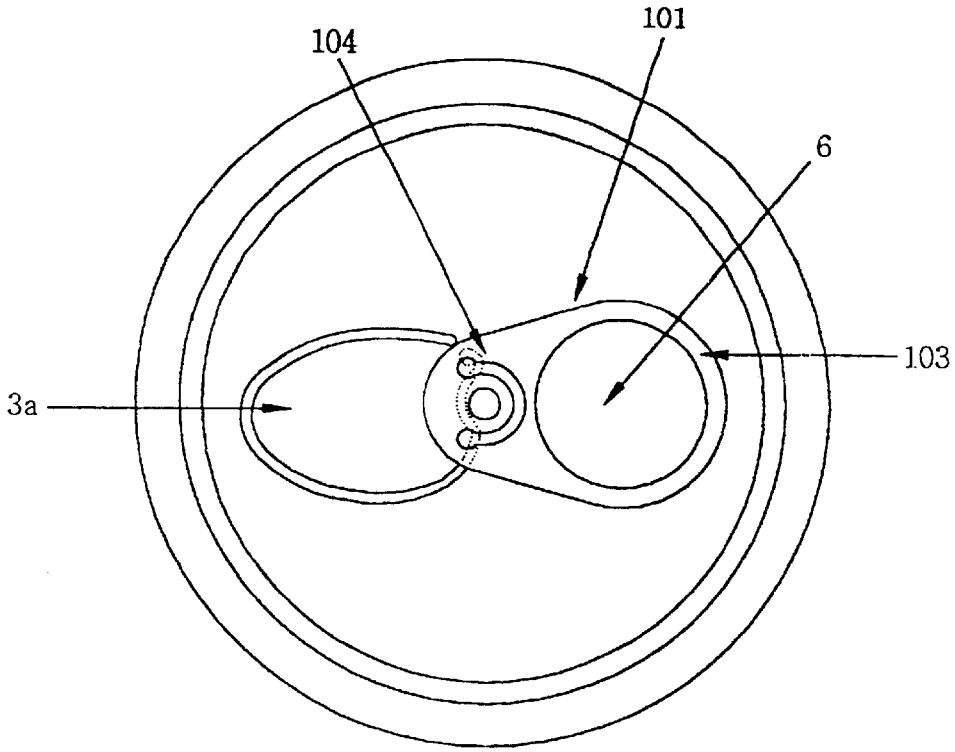
FIG. 17 is a plan view, showing a thumb-operable resilient dome of this invention used with a conventional lever opener attached to the top lid.
Figure 18A:
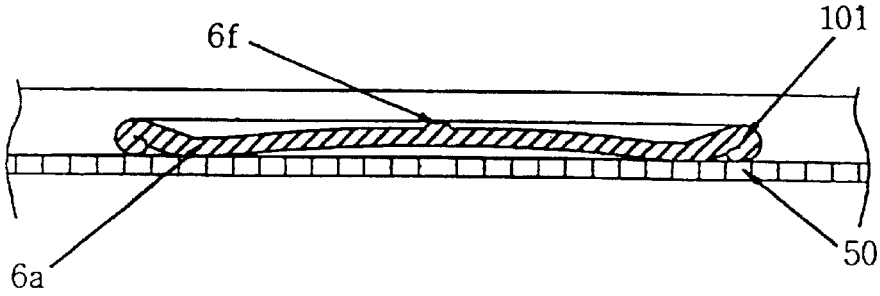
FIGS. 18*a* to 18*d* are cross-sectional views, individually showing a thumb-operable resilient dome formed on the can opener in accordance with another embodiment of this invention.
Figure 18B:
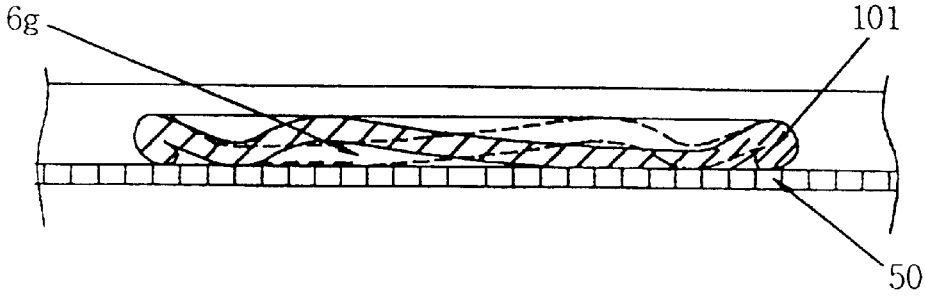
Figure 18C:
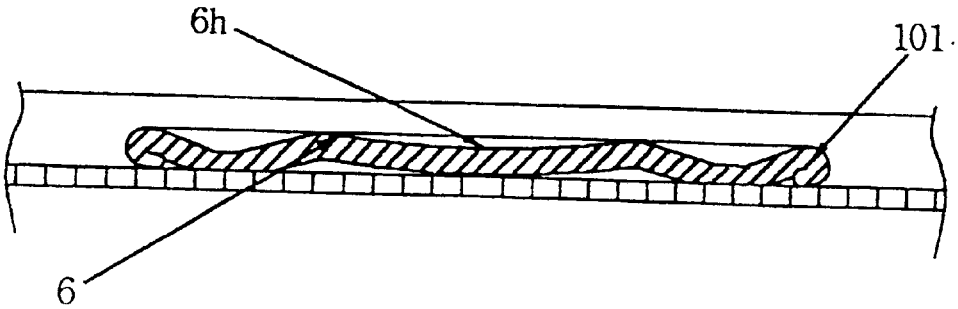
Figure 18D:
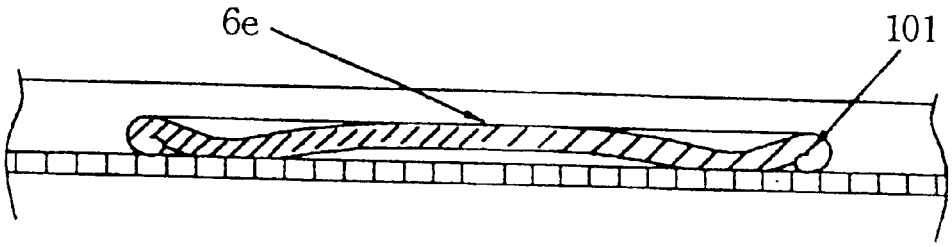
Figure 18E:
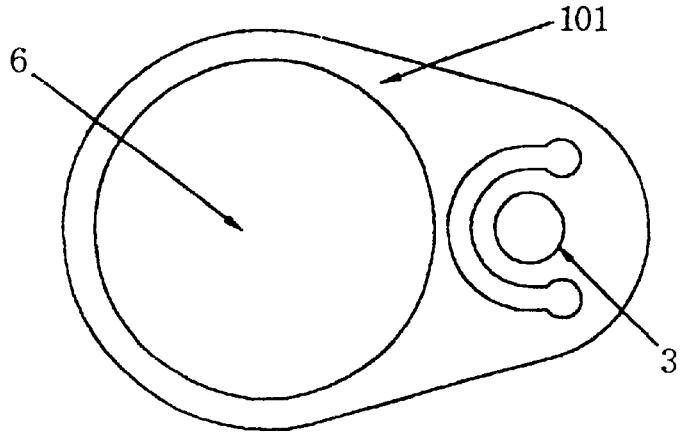
FIGS. 18*e* to 18*l* are plan views, individually showing a can opener in accordance with an embodiment of this invention.
Figure 18F:
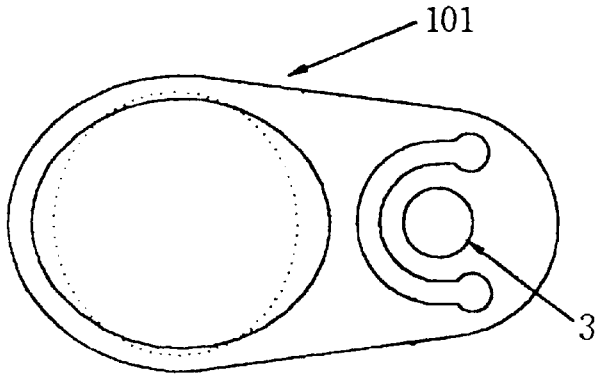
Figure 18G:
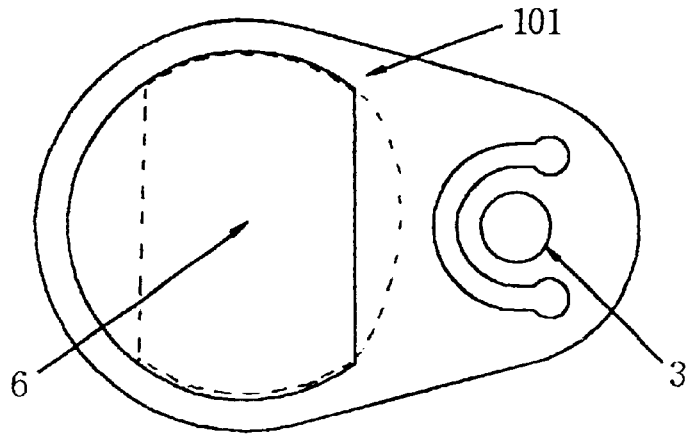
Figure 18H:
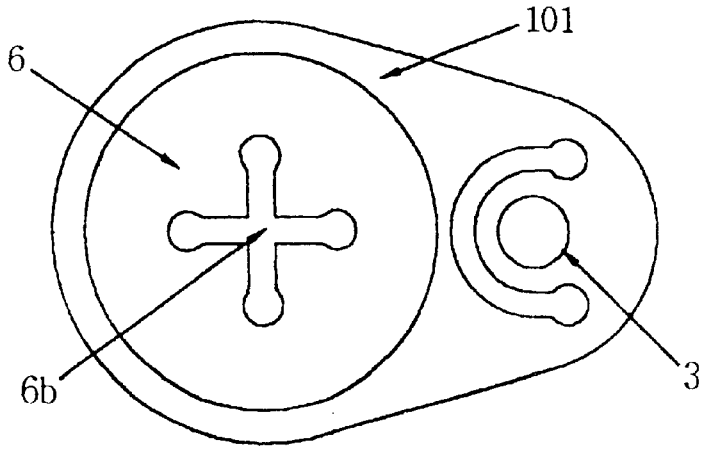
Figure 18I:
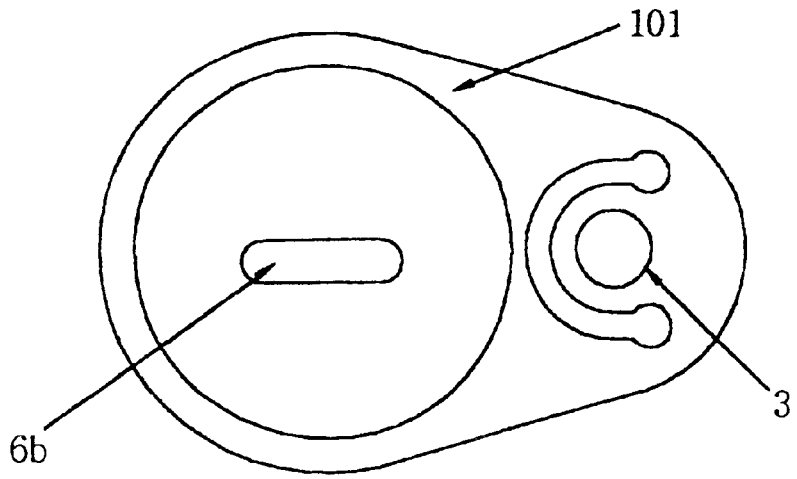
Figure 18J:
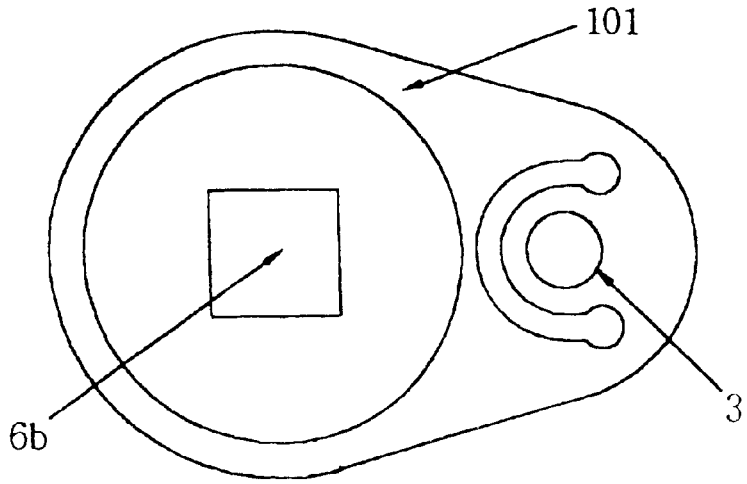
Figure 18K:
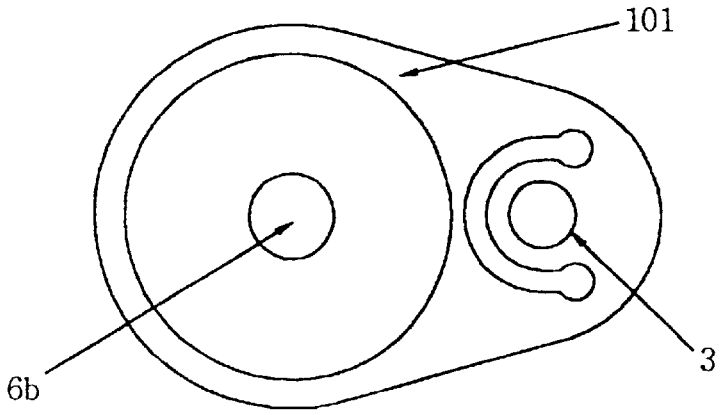
Figure 18L:
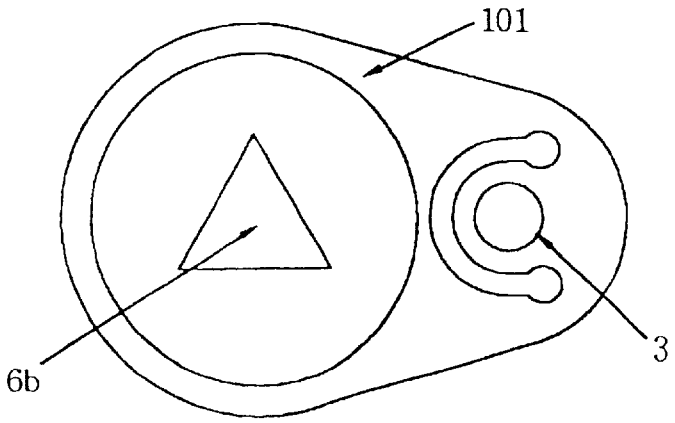
Figure 18M:
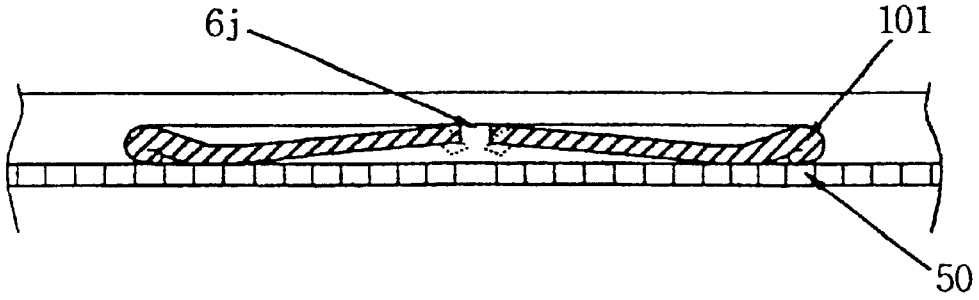
Figure 18N:
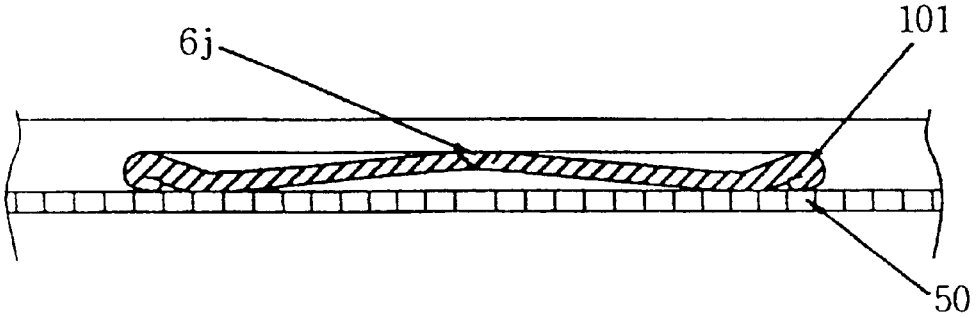
Figure 180:
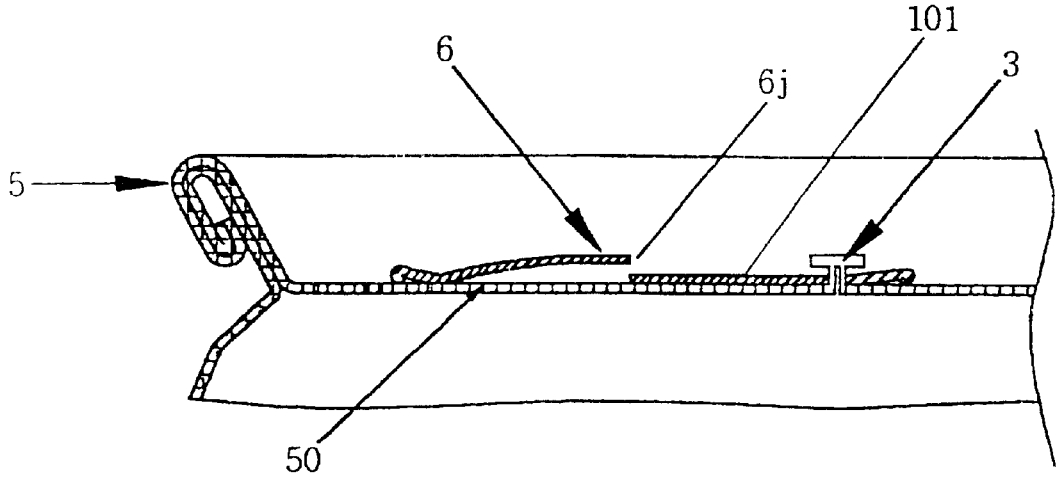
Figure 18P:
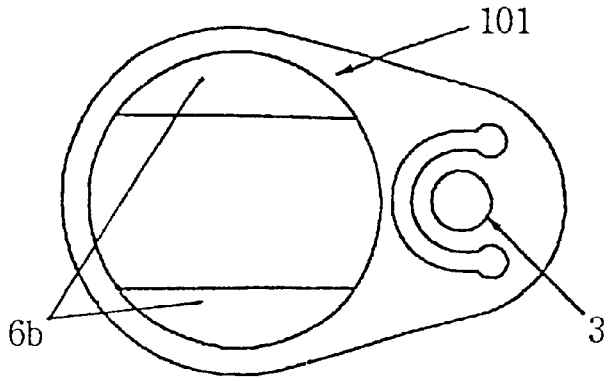
Figure 18Q:
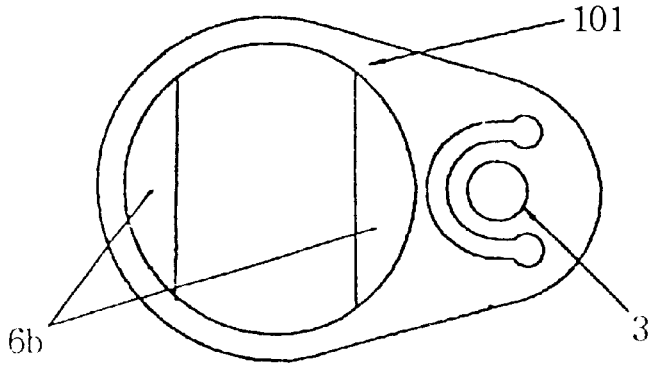
Figure 19A:
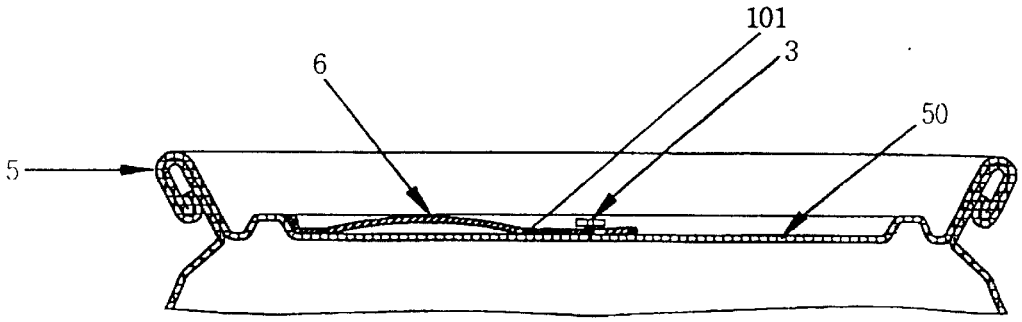
FIGS. 19*a* to 19*e* are cross-sectional views, individually showing the construction of a can opener in accordance with another embodiment of this invention.
Figure 19B:
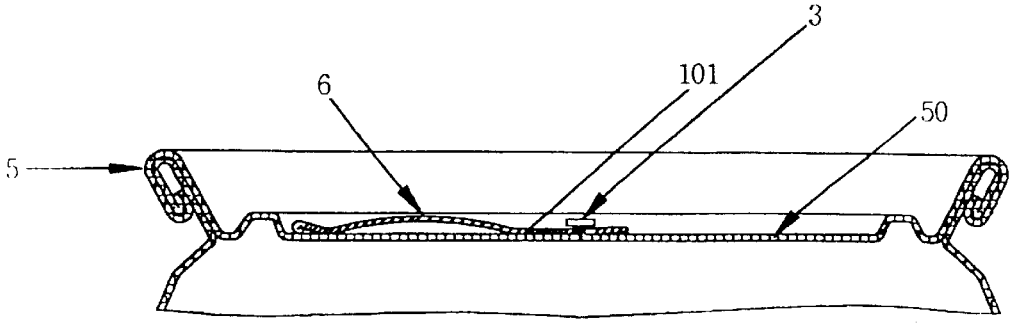
Figure 19C:
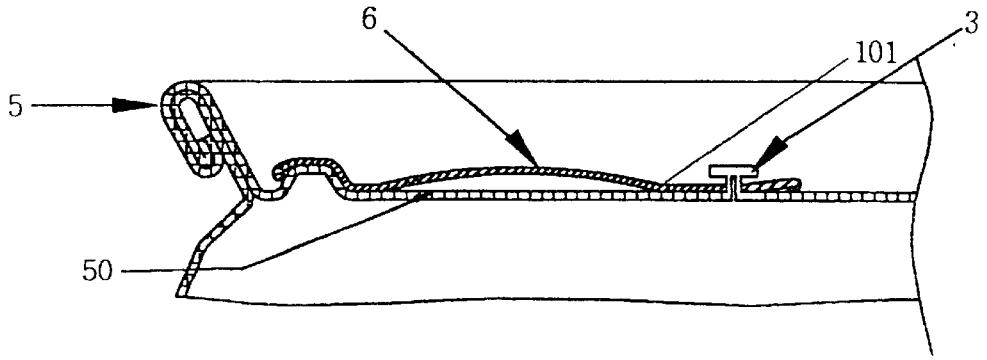
Figure 19D:
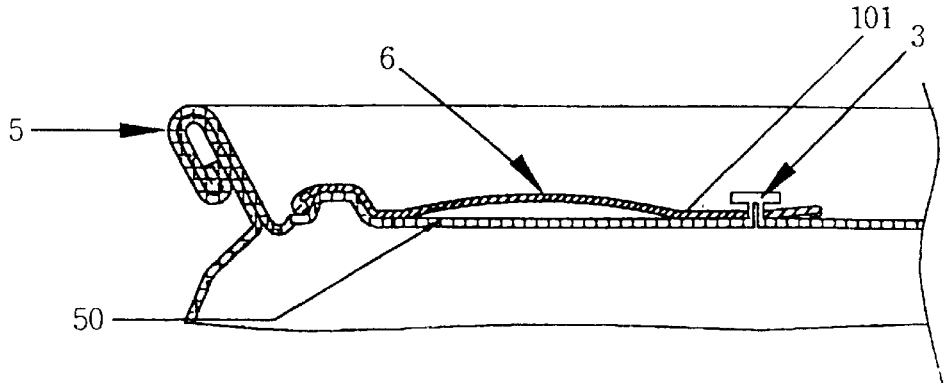
Figure 19E:
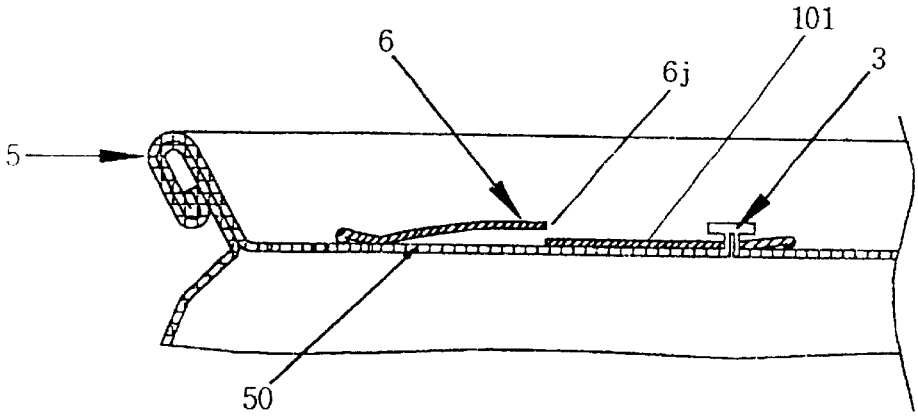
Figure 20A:
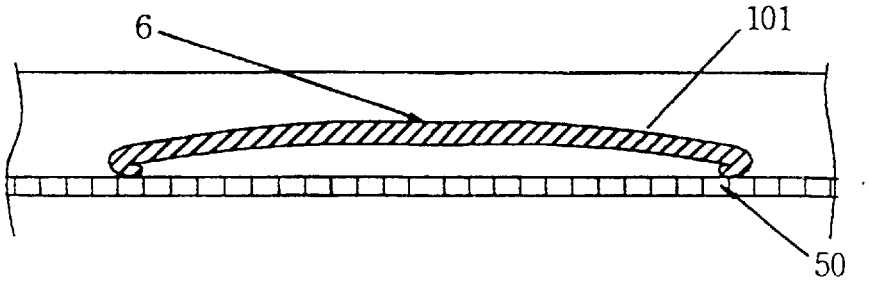
FIGS. 20*a* to 20*d* are cross-sectional views, individually showing a thumb-operable resilient dome formed on the can opener in accordance with still another embodiment of this invention.
Figure 20B:
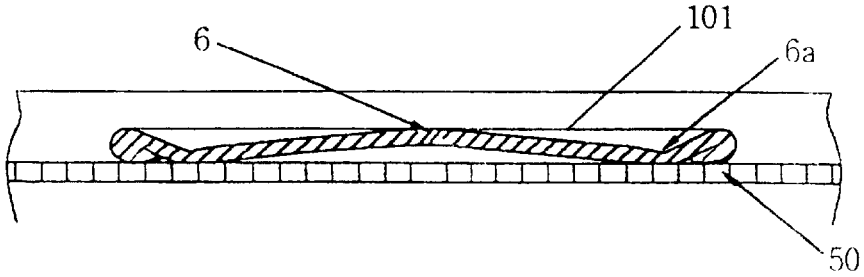
Figure 20C:
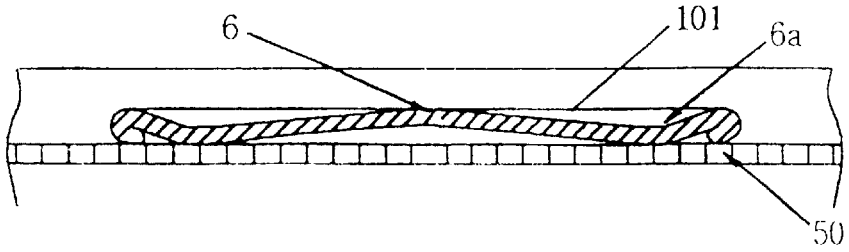
Figure 20D:
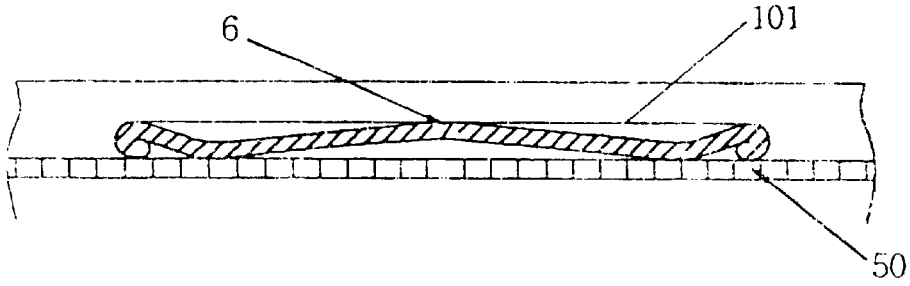

As shown in FIG. 17, the thumb-operable resilient dome 6 of this invention may be used with a conventional can opener or a conventional one-touch can opener 101, which is attached to the top lid of a can using a locking means in the same manner as that described for the sanitary cover 8 of this invention, but is not designed to completely cover the opening piece 3*a* different from the sanitary cover 8. That is, the dome 6 is formed on the opener 101 at a position between the outside end 103 and an arcuate slit 104 of the opener 101. When the resilient dome 6 is pressed down by a thumb, the opener 101 is elastically raised up due to a reaction force of the dome 6, thus being spaced apart from the top lid 50. Therefore, it is easy for a user to grasp and handle the opener 101 when levering up the opener 101 to press down the opening piece 3*a*. In the present invention, the above resilient dome 6 may be designed to have a flat top surface, a nipple, a slanted surface, or a depressed top surface as shown in FIGS. 18*a* to 18*d*. In addition, the above resilient dome 6 may be designed to have a hemispherical profile or another profile modified from such a hemispherical profile as shown in FIGS. 18*e* to 18*g*. Of course, the object of the flat top surface, the nipple, the slanted surface, the depressed top surface, the hemispherical profile or the other profile modified from the hemispherical profile of the dome 6 according to the embodiments of this invention is to improve the resilient reaction of the dome 6 and to give an appropriate reaction force to the dome 6 in accordance with the size and pressure of the can. Furthermore, as shown in FIGS. 18*h* to 18*q*, the above dome 6 may have a regular or irregular pattern capable of allowing the dome 6 to more stably and reliably perform a desired elastic reaction. It is also possible to somewhat freely determine the length of the can opener 101 in accordance the size and shape of a can as shown in FIGS. 19*a* to 19*e*. In addition, the outside end 103 of the opener 101 is somewhat freely designed to have, for example, an arcuate shape. The dome 6 of this invention also may be designed to have the same reaction rim 6*a* as that described for the sanitary cover 8 or to be free from such a reaction rim 6*a* as shown in FIGS. 20*a* to 20*d*. The opener 101, having the thumb-operable resilient dome 6, may be rotatably attached to the top lid 50 of a can in a way such that the opener 101 is normally positioned on the opening piece 3*a* so as to cover the opening piece 3*a* and is selectively rotated to a levering position where the opener 101 is levered up to break the opening piece 3*a* along the depressed seam 3*c*.

INDUSTRIAL APPLICABILITY

As described above, the present invention provides a top lid for beverage cans with an opener integrated sanitary cover. The sanitary cover is designed to cover the area around the opening piece defined on the top lid by a depressed seam, thus protecting the lip contact portion of the top lid from atmospheric impurities and keeping the can sanitary during storage of the can. The sanitary cover has a reinforced opener part which presses down the opening piece and breaks the piece along thee depressed seam when the cover is levered up. The opener part has a reinforcing means improving the stiffness of the opener part, and so the opener part reliably breaks the opening piece without failure even though a high pressure acts on the interior surface of the opening piece. Therefore, the sanitary cover acts as a one-touch opener while opening the can. In the present invention, the configuration and arrangement of the reinforcing means for the opener part may be freely changed in accordance with the designing conditions of the can, or the interior pressure acting on the opening piece and the size of the can. The thumb-operable resilient dome of this invention may be preferably used with a conventional lever opener attached to the top lid. In such a case, the lever opener is elastically raised up when the dome is pressed down by a thumb. It is thus easy for a user to grasp and handle the opener while levering up the opener to open the top lid of the can.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A top lid for beverage cans, comprising a sanitary cover attached to the top lid using a locking member and adapted for keeping a lip contact portion of the top lid sanitary during storage of the can, wherein said sanitary cover comprises:

a thin plate body having a sanitary cover part at an outside end portion thereof and exteriorly attached to the top lid at an inside end portion thereof using said locking member, thus covering an opening piece, defined on the top lid by a depressed seam, while covering the lip contact portion around the opening piece by the sanitary cover part;

a thumb-operable resilient dome formed on the sanitary cover part and adapted for elastically raising the cover part above the top lid when the dome is pressed down;

an opener part defined on the thin plate body by a cutting line at an intermediate position between the locking member and the dome;

a depressed bending line formed on the thin plate body while transversely and linearly extending outwardly from each end of said cutting line to an outside edge of the thin plate body, with the thin plate body being bendable along said bending line when the cover is levered up so as to break the opening piece along the depressed seam using the opener part; and reinforcing means for improving stiffness of said opener part, thus allowing the opener part to break the opening piece along the depressed seam without failure.

2. The top lid according to claim 1, wherein said sanitary cover part of the thin plate body reaches a position just inside a rim of the can, said rim seaming a junction between the top lid and a sidewall of the can.

3. The top lid according to claim 1, wherein said sanitary cover part of the thin plate body reaches a boundary of said opening piece.

4. The top lid according to claim 1, wherein the outside edge of said sanitary cover part is closely seated in a seating groove, formed on the top lid at a position inside an interior wall of a seamed rim of said can, while being inserted into the seating groove to a length equal to a thickness of said sanitary cover part.

5. The top lid according to claim 1, wherein a top wall of said top lid has a flat surface, with the sanitary cover being attached to the flat top wall using the locking member.

6. The top lid according to claim 1, wherein said reinforcing means comprises a first reinforcing rib having a folded and compact rectangular cross-section, said first reinforcing rib axially formed on said opener part within a range from an outside edge of said opener part to a position just outside said resilient dome.

7. The top lid according to claim 1, wherein said reinforcing means comprises a second reinforcing rib having an arcuate cross-section, said second reinforcing rib axially formed on said opener part within a range from an outside edge of said opener part to a position just outside said resilient dome.

8. The top lid according to claim 1, wherein said reinforcing means comprises first and second reinforcing ribs respectively having a folded and compact rectangular cross-section and an arcuate cross-section, said first and second reinforcing ribs axially and parallely formed on said opener part within a range from an outside edge of said opener part to a position just outside said resilient dome.

9. The top lid according to claim 1, wherein said reinforcing means comprises a regular or irregular rugged pattern consisting of a plurality of embossments and depressions formed on said opener part.

10. The top lid according to claim 1, wherein said cutting line is depressed to form a depressed seam, or is completely cut to form a slit.

11. The top lid according to claim 1, wherein said sanitary cover is attached to the top lid using two or more locking members.

12. The top lid according to claim 1, wherein said resilient dome has both a reaction rim formed along an outside edge of the resilient dome and a reaction slit formed on a top portion of the resilient dome, both the reaction rim and the reaction slit allowing the resilient dome to stably and reliably perform a desired elastic reaction.

13. The top lid according to claim 1, wherein said resilient dome has a hemispherical profile or another profile modified from the hemispherical profile.

14. The top lid according to claim 1, wherein said cutting line forms an arcuate profile or another profile modified from the arcuate profile.

15. The top lid according to claim 1, wherein a top portion of said resilient dome has a hemispherical profile or another profile modified from the hemispherical profile, with a regular or irregular slit being formed on said top portion of the dome, thus allowing the dome to stably and reliably perform a desired elastic reaction.

16. The top lid according to claim 15, wherein said slit on the top portion of the resilient dome is completely or incompletely perforated.

17. The top lid according to claim 1, wherein said resilient dome has a flat top surface, a slanted top surface, or a depressed top surface.

18. A top lid for beverage cans, comprising an opening piece defined by a depressed seam and selectively broken along the depressed seam so as to form an opening on the top lid, and an opener attached to the top lid using a locking member with an inside end of the opener being positioned on the opening piece to press down the opening piece when necessary and an outside end being positioned inside an interior wall of a seamed rim of said top lid, wherein a thumb-operable resilient dome is formed on said opener at a position between said outside end and an arcuate slit formed around the locking member.

19. The top lid according to claim 18, wherein a reaction rim is formed along an outside edge of said resilient dome so as to allow the dome to stably and reliably perform a desired elastic reaction, and said inside end of the opener extends until it reaches a position just inside the depressed seam.

20. The top lid according to claim 18, wherein said opener is rotatably attached to the top lid using the locking member in a way such that the opener is normally positioned on the opening piece so as to cover the opening piece and is selectively rotated to a levering position where the opener is levered up to break the opening piece along the depressed seam.

21. The top lid according to claim 18, wherein said resilient dome has a flat top surface, a slanted top surface, or a depressed top surface.

22. The top lid according to claim 18, wherein a top portion of said resilient dome has a hemispherical profile or another profile modified from the hemispherical profile, with a regular or irregular slit being formed on said top portion of the dome, thus allowing the dome to stably and reliably perform a desired elastic reaction.

23. The top lid according to claim 22, wherein said slit on the top portion of the resilient dome is completely or incompletely perforated.

* * * * *